US009682836B2

(12) United States Patent
Kowase

(10) Patent No.: US 9,682,836 B2
(45) Date of Patent: Jun. 20, 2017

(54) SHEET CONVEYING DEVICE, AND IMAGE FORMING APPARATUS AND IMAGE FORMING SYSTEM INCLUDING THE SAME

(71) Applicant: KONICA MINOLTA, INC., Chiyoda-ku, Tokyo (JP)

(72) Inventor: Kazuhiko Kowase, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/092,262

(22) Filed: Apr. 6, 2016

(65) Prior Publication Data

US 2016/0318728 A1 Nov. 3, 2016

(51) Int. Cl.
*B65H 29/60* (2006.01)
*B65H 5/06* (2006.01)
(Continued)

(52) U.S. Cl.
CPC ..... *B65H 5/062* (2013.01); *B65H 29/125* (2013.01); *B65H 29/60* (2013.01); *B65H 31/24* (2013.01);
(Continued)

(58) Field of Classification Search
CPC .. G03G 15/70; G03G 15/234; G03G 15/5012; G03G 2215/00552; B65H 29/60;
(Continued)

(56) References Cited

U.S. PATENT DOCUMENTS 5,172,162 A 12/1992 Taneda
8,417,176 B2 * 4/2013 Shoji ..... G03G 15/6579 271/184
(Continued)

FOREIGN PATENT DOCUMENTS

EP 0859289 A2 8/1998
JP 09124208 A 5/1997
(Continued)

OTHER PUBLICATIONS

Related U.S. Appl. No. 15/092,302; First named Inventor: Kazuhiko Kowase; Title: "Sheet Conveying Device, and Image Forming Apparatus and Image Forming System Including the Same"; filed Apr. 6, 2016.

*Primary Examiner* — Luis A Gonzalez
(74) *Attorney, Agent, or Firm* — Holtz, Holtz & Volek PC

(57) ABSTRACT

A sheet conveying device includes: a conveying unit configured to convey a sheet along a conveying path; a switching unit configured to switch a sheet conveying destination; a delivering unit configured to deliver the sheet on the delivery path toward the device at the sheet conveying destination; a reversing unit configured to first convey the sheet from the reversing port toward the outside of the casing and then delivers the sheet from the position toward a circulation path while reversing the conveying direction of the sheet; a circulating unit configured to convey the sheet delivered toward the circulation path along the circulation path and return the sheet to the conveying path while the sheet is reversed; and a control unit configured to control the conveying unit, the reversing unit, the delivering unit, the circulating unit, and the switching unit.

18 Claims, 15 Drawing Sheets

(51) Int. Cl.

| | |
|---|---|
| ***B65H 29/12*** | (2006.01) |
| ***B65H 31/24*** | (2006.01) |
| ***B65H 43/00*** | (2006.01) |
| ***B65H 85/00*** | (2006.01) |
| ***G03G 15/00*** | (2006.01) |

(52) U.S. Cl.
CPC ..... *B65H 43/00* (2013.01); *B65H 85/00* (2013.01); *G03G 15/5012* (2013.01); *G03G 15/70* (2013.01); *B65H 2301/33312* (2013.01); *B65H 2404/632* (2013.01); *B65H 2405/332* (2013.01); *B65H 2511/11* (2013.01); *B65H 2515/112* (2013.01); *B65H 2601/11* (2013.01); *B65H 2801/06* (2013.01); *B65H 2801/27* (2013.01)

(58) Field of Classification Search
CPC ..... B65H 29/62; B65H 2601/11; B65H 2511/528; B65H 2513/42
See application file for complete search history.

(56) References Cited

U.S. PATENT DOCUMENTS 8,960,673 B2 * 2/2015 Yoshida ..... B65H 29/125 271/225
9,096,398 B2 * 8/2015 Nakagaki ..... B65H 7/125

FOREIGN PATENT DOCUMENTS

JP 2014024614 A 2/2014
JP 2014119634 A 6/2014

* cited by examiner

SHEET CONVEYING DEVICE, AND IMAGE FORMING APPARATUS AND IMAGE FORMING SYSTEM INCLUDING THE SAME

The entire disclosure of Japanese Patent Application No. 2015-094138 filed on May 1, 2015 including description, claims, drawings, and abstract are incorporated herein by reference in its entirety.

BACKGROUND OF THE INVENTION

Field of the Invention

The present invention relates to a sheet conveying technique, and more particularly, to a purging technique.

Description of the Related Art

In general, a sheet conveying device mounted on an image forming apparatus such as a printer and a copying machine continuously conveys a plurality of sheets along one route. A printing process or the like is sequentially performed on these sheets at a high speed of several tens to several hundreds or more of ppm.

When a jam (a paper jam) occurs at a certain position on the route, the image forming apparatus interrupts the process and causes a user to remove the jammed sheet. At this time, different sheets located before and after the jammed sheet are also forcedly stopped on the route. In order to resume the process, these sheets also need to be removed from the route in principle. However, the user feels troublesome whenever removing these sheets.

Among the sheet conveying devices of the related art, there is known a sheet conveying device devised for the user who feels troublesome in the sheet removing operation. Here, when the image forming apparatus interrupts the printing process or the like due to the jam or the like, all movable sheets are automatically discharged from the route. The sheet discharging operation which is performed by the sheet conveying device along with the process interrupting operation of the image forming apparatus will be referred to as a "purging operation". Generally, the sheet as a purging target is discharged to a dedicated tray provided separately from a normal sheet discharging tray.

Patent Literature 1: JP 2014-119634 A

Since some space is needed for the installation of a purging tray, the image forming apparatus having the purging function is limited to a comparatively large-sized image forming apparatus so far. However, there is a demand for installing the purging function even in a medium-sized image forming apparatus used in an office or the like in accordance with the recent trend of the high functionality of the image forming apparatus.

Meanwhile, when the purging tray is provided in the medium-sized image forming apparatus, it is difficult to meet a decrease in size and cost strongly required in the medium-sized image forming apparatus.

As the medium-sized image forming apparatus used for an office, for example, an image forming system having a duplex printing function illustrated in FIG. 16 is known.

An image forming system 950 illustrated in FIG. 16 includes an image forming apparatus 900, a relay device 910, and a post-processing device 920. The image forming apparatus 900 is a color copying machine having a duplex printing function. In the duplex printing mode, the image forming system 950 performs the following operation.

First, Y, M, C, and K colors of toner images formed by an imaging part 901 are transferred in multiple layers onto an intermediate transfer belt 906 traveling in the circumferential direction as indicated by the arrow. The color toner images which are transferred onto the intermediate transfer belt 906 in multiple layers are secondly transferred onto a front surface of a sheet SHT fed from a cassette 902 at a secondary transfer position 907.

When the sheet SHT having the toner images secondarily transferred thereonto passes through a fixing part 903, the toner image is fixed onto the front surface of the sheet SHT and the sheet SHT is guided to a reversing part 904 through a branch point 960.

The reversing part 904 reversely rotates the reversing roller 941 immediately before the tail end of the sheet SHT reaches the reversing roller 941 while the leading end of the sheet SHT is caused to protrude outward from the reversing port 940 provided in the casing by the reversing roller 941. Accordingly, the conveying direction of the sheet SHT is switched back (reversed). The reversed sheet SHT is guided to a circulation part 905.

The sheet SHT which is guided to the circulation part 905 is conveyed along a circulation path 951 and is returned to the secondary transfer position 907. During the circulating and conveying operation, a toner image forming operation is performed by the imaging part 901. Thus, when the sheet SHT passes through the secondary transfer position 907, the toner image on the intermediate transfer belt 906 is secondarily transferred onto the rear surface of the sheet SHT.

When the sheet SHT having the toner image secondarily transferred thereonto passes through the fixing part 903, the toner image is fixed onto the rear surface of the sheet SHT and the sheet SHT is conveyed from the branch point 960 to the post-processing device 920 through the relay device 910. In the post-processing device 920, post-processing such as a staple-binding process is performed on the sheet SHT and the post-processed sheet SHT is discharged.

By a sheet reversing mechanism having such a reversing port 940, a space necessary for switching back the sheet SHT is saved. Thus, if the outside of the reversing port 940 can be also used as a purging destination, a purging function can be provided in the image forming apparatus 900 while the casing of the image forming apparatus 900 is maintained in a small size.

As the purging function, for example, a function is considered in which sheets SH1 to SH3 are discharged to the outside of the apparatus from the reversing port 940 when the sheets SH1 to SH3 are conveyed inside the image forming apparatus 900 in the case where a jam occurs in a sheet SH0 of the post-processing device 920.

Incidentally, for example, if the sheet SH1 guided to the relay device 910 through the branch point 960 passes through the branch point 960 at the jam detection time point, the sheet SH1 cannot be conveyed toward the reversing port 940 in time even when the sheet SH1 is stopped immediately. Then, when the stopped sheet SH1 stays at the position of the branch point 960 and blocks the conveying route from the branch point 960 toward the reversing port 940, the subsequent sheets SH2 and SH3 cannot be guided to the reversing port 940.

Such a problem can generally occur in a sheet conveying device having the above-described reversing mechanism in addition to the sheet conveying device provided in the image forming apparatus.

SUMMARY OF THE INVENTION

The present invention has been made in view of the above-described problems, and an object thereof is to provide a sheet conveying device including a reversing mechanism, conveying a sheet so that a part of the sheet protrudes outward from a reversing port and reversing the sheet, and having a purging function capable of reducing the effort of the user in a sheet removing operation as much as possible and to provide an image forming apparatus and an image forming system including the sheet conveying device.

To achieve the abovementioned object, according to an aspect, a sheet conveying device configured to convey a sheet toward a device at a conveying destination in a normal operation state and to interrupt the sheet conveying operation toward the device at the conveying destination when a jam is detected, the sheet conveying device reflecting one aspect of the present invention comprises: a conveying unit configured to convey a sheet along a conveying path; a switching unit configured to switch a sheet conveying destination from a branch point as a downstream end of the conveying path to any one of a delivery path extending toward the device at the sheet conveying destination and a reversing port formed as an opening of a casing of the sheet conveying device so that a space outside the casing is used as a space for reversing the sheet conveying direction; a delivering unit configured to deliver the sheet on the delivery path toward the device at the sheet conveying destination; a reversing unit configured to first convey the sheet from the reversing port toward the outside of the casing to a position in which a part of the sheet protrudes and then delivers the sheet from the position toward a circulation path while reversing the conveying direction of the sheet; a circulating unit configured to convey the sheet delivered toward the circulation path along the circulation path and return the sheet to the conveying path while the sheet is reversed; and a control unit configured to control the conveying unit, the reversing unit, the delivering unit, the circulating unit, and the switching unit so that a second sheet is continuously conveyed until a tail end of the second sheet in the sheet conveying direction passes through the branch point and switches a conveying destination of a third sheet reaching the branch point to the reversing port after the tail end of the second sheet in the sheet conveying direction passes through the branch point so that the third sheet is purged from the reversing port toward the outside of the casing while not being reversed when the second sheet conveyed from the branch point to the delivery path currently passes through the branch point and there is the third sheet currently conveyed by at least one of the conveying unit, the reversing unit, and the circulating unit at the jam detection time point of the first sheet in the device at the conveying destination.

Further, the control unit preferably includes a determination unit configured to determine whether a leading end of a fourth sheet in the sheet conveying direction reaches a stop position of the first sheet before the tail end of the second sheet in the sheet conveying direction passes through the branch point on the assumption that the fourth sheet and the second sheet are continuously conveyed when the fourth sheet is currently conveyed between the first sheet and the second sheet on the delivery path at the jam detection time point, and when the determination is made, the conveying operation of the fourth sheet is preferably interrupted and, when the tail end of the second sheet in the sheet conveying direction passes through the branch point, the conveying operation of the second sheet is preferably stopped.

Here, the sheet conveying device further preferably comprises an escape section provided at a halfway position of the delivery path so as to receive the second sheet stopped after the continuous conveying operation thereof such that the second sheet overlaps the stopped fourth sheet.

Here, the sheet conveying device further preferably comprises a pair of first rotating and conveying members provided at the upstream side of the escape section in the sheet conveying direction on the delivery path and conveying the sheet in a nipping state and a pair of second rotating and conveying members provided at the downstream side of the escape section in the sheet conveying direction and conveying the sheet in a nipping state, the escape section is preferably provided with an expanded part receiving the sheet in a bent state, and when the determination is made, the control unit preferably stops the rotation of the second rotating and conveying members so as to interrupt the conveying operation of the fourth sheet, continues the rotation of the first rotating and conveying member, and stops the rotation of the first rotating and conveying members so as to stop the conveying operation of the second sheet when the tail end of the second sheet in the sheet conveying direction passes through the branch point.

Here, the control unit preferably prohibits the purging operation of the third sheet and stops each sheet conveying operation when the relation of Equation 1:

$$Ls<(L1+L2+L3) \quad \text{(Equation 1)}$$

is not satisfied on the assumption that L1 denotes a distance on the conveying route from the pair of first rotating and conveying members to the pair of second rotating and conveying members, L2 denotes a distance on the conveying route from the branch point to the pair of first rotating and conveying members, L3 denotes an amount in which a maximal bent amount obtained by bending a straight sheet along the expanded part is converted into a length of the sheet in the sheet conveying direction, and Ls denotes a length of the second sheet in the sheet conveying direction.

Further, on the assumption that Lq denotes a distance on the conveying route from the leading end of the second sheet in the sheet conveying direction to the pair of second rotating and conveying members at the jam detection time point, L3 denotes an amount in which a maximal bent amount obtained by bending a straight sheet along the expanded part is converted into a length of the sheet in the sheet conveying direction, and Lu denotes (Lq+L3) when the leading end of the second sheet in the sheet conveying direction does not reach the pair of second rotating and conveying members at the jam detection time point, the control unit preferably stops the rotation of the first rotating and conveying members so as to stop the conveying operation of the second sheet and performs the purging operation of the third sheet when the tail end of the second sheet in the sheet conveying direction passes through the branch point until the conveying distance of the second sheet from the jam detection time point becomes Lu after the rotation of the second rotating and conveying members is stopped, and the control unit preferably stops the rotation of the first rotating and conveying members so as to stop the conveying operation of the second sheet, prohibits the purging operation of the third sheet, and stops the conveying operation of the third sheet when the tail end of the second sheet in the sheet conveying direction does not pass through the branch point at the time point in which the conveying distance becomes Lu.

Furthermore, the control unit preferably prohibits the purging operation of the third sheet and stops each sheet conveying operation when Equation 2:

$$Lt\leq(L1+L3) \quad \text{(Equation 2)}$$

is not satisfied on the assumption that L1 denotes a distance on the conveying route from the pair of first rotating and conveying members to the pair of second rotating and conveying members, L3 denotes an amount in which a maximal bent amount obtained by bending a straight sheet along the expanded part is converted into a length of the sheet in the sheet conveying direction, and Lt denotes a length from a part nipped by the pair of second rotating and conveying members in the fourth sheet to the tail end of the fourth sheet in the sheet conveying direction at the jam detection time point.

Further, the sheet conveying device further preferably comprises: an escape section provided at a halfway position of the delivery path and having an expanded part receiving the sheet in a bent state; a pair of first rotating and conveying members provided at the upstream side of the escape section in the sheet conveying direction on the delivery path and conveying the sheet in a nipped state; and a pair of second rotating and conveying members provided at the downstream side of the escape section in the sheet conveying direction and conveying the sheet in a nipped state, and the control unit preferably includes a determination unit configured to determine whether a leading end of the second sheet in the sheet conveying direction reaches the stop position of the first sheet before the tail end of the second sheet in the sheet conveying direction passes through the branch point on the assumption that the second sheet is continuously conveyed when another sheet is not conveyed between the first sheet and the second sheet on the delivery path at the jam detection time point, and when the determination is made, the rotation of the second rotating and conveying members is preferably stopped, the rotation of the first rotating and conveying members is preferably continued, and when the tail end of the second sheet in the sheet conveying direction passes through the branch point, the rotation of the first rotating and conveying member is preferably stopped so as to stop the conveying operation of the second sheet.

Furthermore, the sheet conveying device further preferably comprises: a pair of first rotating and conveying members conveying the sheet in a nipped state on the delivery path; and a pair of second rotating and conveying members provided at the downstream side of the pair of first rotating and conveying members in the sheet conveying direction and conveying the sheet toward the downstream side in the sheet conveying direction while nipping the sheet conveyed from the pair of first rotating and conveying members, and the control unit preferably stops the rotation of the second rotating and conveying members and continues the rotation of the first rotating and conveying members at the jam detection time point and stops the rotation of the first rotating and conveying members so as to stop the conveying operation of the second sheet when the tail end of the second sheet in the sheet conveying direction passes through the branch point.

Here, the control unit preferably stops the purging operation and stops each sheet conveying operation if the relation of Equation 3:

$$Ls<(L1+L2) \quad \text{(Equation 3)}$$

is not satisfied when the leading end of the second sheet in the sheet conveying direction does not reach the pair of second rotating and conveying members on the assumption that L1 denotes a distance on the conveying route from the pair of first rotating and conveying members to the pair of second rotating and conveying members, L2 denotes a distance on the conveying route from the branch point to the pair of first rotating and conveying members, and Ls denotes a length of the second sheet in the sheet conveying direction.

Further, the sheet conveying device further preferably comprises an escape section having an expanded part receiving a sheet in a bent state while being provided between the pair of first rotating and conveying members and the pair of second rotating and conveying members at a halfway position of the delivery path, and on the assumption that Lq denotes a distance on the conveying route from the leading end of the second sheet in the sheet conveying direction to the pair of second rotating and conveying members at the jam detection time point, L3 denotes an amount in which a maximal bent amount obtained by bending a straight sheet along the expanded part is converted into a length of the sheet in the sheet conveying direction, and Lu denotes (Lq+L3) when the leading end of the second sheet in the sheet conveying direction does not reach the pair of second rotating and conveying members at the jam detection time point, when the tail end of the second sheet in the sheet conveying direction passes through the branch point until the conveying distance of the second sheet from the jam detection time point becomes Lu after the rotation of the second rotating and conveying members is stopped, the control unit preferably stops the rotation of the first rotating and conveying members so as to stop the conveying operation of the second sheet and performs the purging operation of the third sheet, and when the tail end of the second sheet in the sheet conveying direction does not pass through the branch point at the time point in which the conveying distance becomes Lu, the control unit preferably stops the rotation of the first rotating and conveying members so as to stop the conveying operation of the second sheet, stops the purging operation of the third sheet, and stops the conveying operation of the third sheet.

Furthermore, when there is a sheet satisfying a condition in which a leading end of the third sheet in the sheet conveying direction reaches the branch point before the conveying destination is completely switched from the delivery path to the reversing port by the switching unit on the assumption that the third sheet not actually passing through the branch point and reaching the branch point at the first time is continuously conveyed at the jam detection time point, the control unit preferably regards the sheet as the second sheet and continues the conveying operation of the sheet while keeping the sheet conveying destination to the delivery path.

Further, the control unit preferably stops each sheet conveying operation by prohibiting the purging operation when the second sheet is a predetermined type of sheet.

Here, the predetermined type of sheet is preferably any one of a high-quality sheet, a glossy sheet, a coated sheet, and a color sheet.

Further, the control unit preferably stops each sheet conveying operation by prohibiting the purging operation when the third sheet is a specific type of sheet.

Here, the specific type of sheet is preferably a thin sheet having a basis weight smaller than a predetermined value.

To achieve the abovementioned object, according to an aspect, an image forming apparatus configured to form an image on a sheet conveyed by a sheet conveying part, the image forming apparatus reflecting one aspect of the present invention comprises the sheet conveying device as the sheet conveying part.

To achieve the abovementioned object, according to an aspect, an image forming system reflecting one aspect of the present invention comprises: the image forming apparatus; and a post-processing device configured to perform predetermined post-processing on a sheet having an image formed thereon by the image forming apparatus, and a device at a sheet conveying destination of a sheet conveying device in the image forming apparatus is the post-processing device.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of a sheet conveying device, and an image forming apparatus and an image forming system including the sheet conveying device according to the present invention will be described with reference to the drawings. However, the scope of the invention is not limited to the illustrated examples.

[Appearance of Image Forming System]

Figure 1:
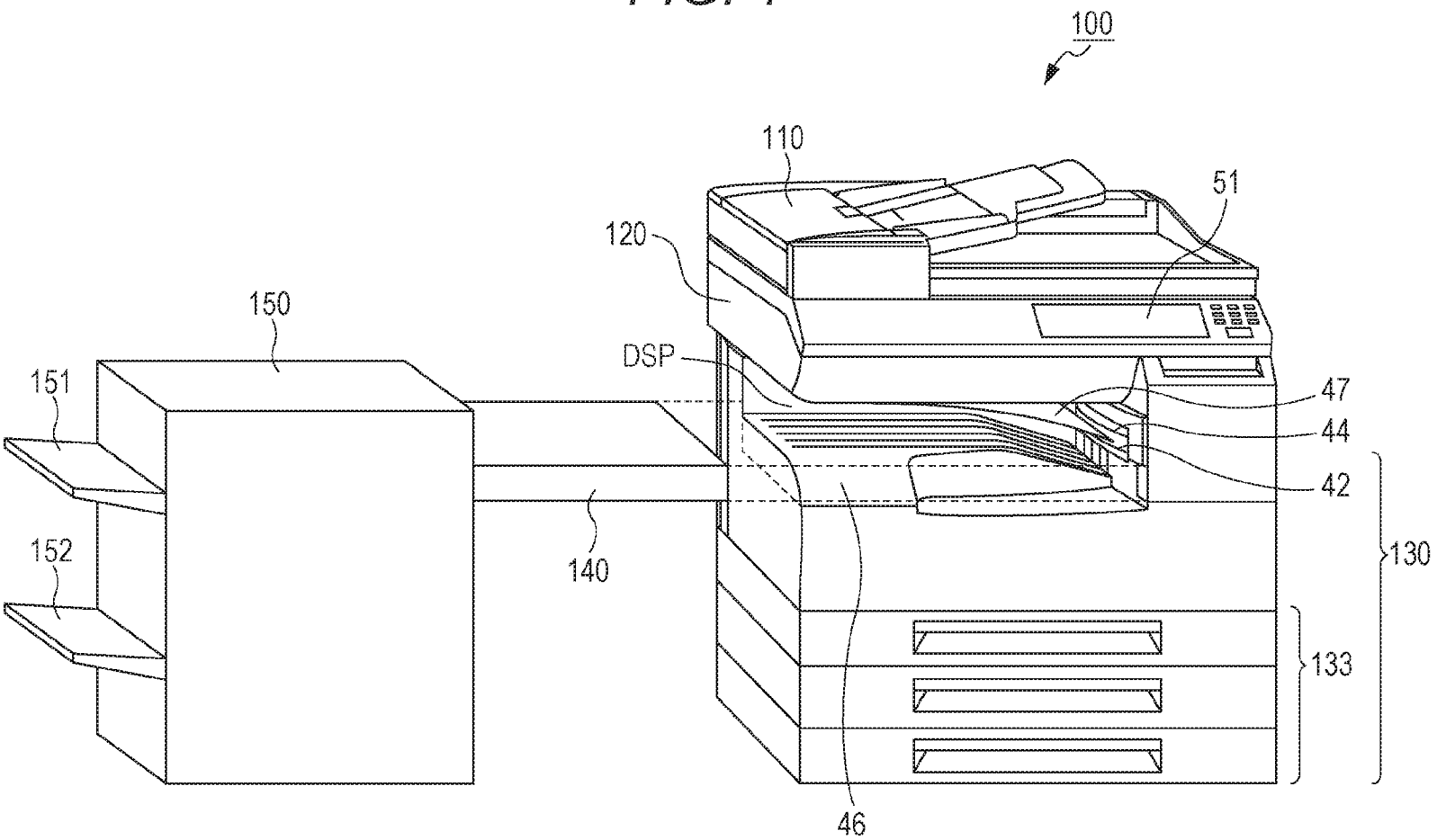
FIG. 1 is a perspective view illustrating the appearance of an image forming system.

FIG. 1 is a perspective view illustrating the appearance of an image forming system according to the embodiment of the present invention. The image forming system includes an MFP (Multi-Function Peripheral) 100, a relay unit 140, and a post-processing device 150.

The MFP 100 has the functions of a scanner, a color copying machine, and a color laser printer. As illustrated in FIG. 1, an ADF (Auto Document Feeder) 110 is attached to an upper surface of a casing of the MFP 100 so as to be openable and closable. A scanner 120 is built in the upper part of the casing located directly below the ADF 110, and a printer 130 is built in the lower part of the casing. A sheet feeding cassette 133 is attached to the bottom part of the printer 130 so as to be drawable.

The MFP 100 is of a sheet ejection type. That is, a sheet discharging tray 46 is separably installed in a gap DSP between the scanner 120 and the printer 130, and receives the sheet discharged from a sheet discharging port 42 at the back side of the gap DSP. At the gap DSP, a reversing tray 47 is provided on the sheet discharging tray 46. In a duplex printing mode, a sheet having an image printed on a front surface (a first surface) is switched back (reversed) on the reversing tray 47. That is, the sheet is first conveyed from a reversing port 44 opened above the sheet discharging port 42 to the upward protruding position of the reversing tray 47 and then is drawn into the reversing port 44 again while the conveying direction is reversed.

The relay unit 140 is assembled to a casing part of the MFP 100 instead of the sheet discharging tray 46. The relay unit 140 receives the sheet from the sheet discharging port 42 and relays the sheet to a post-processing device 150.

The post-processing device 150 performs post-processing on a sheet bundle received from the sheet discharging port 42 through the relay unit 140 in response to the instruction from the MFP 100. The post-processing includes, for example, a process of evenly arranging the sheet bundle and a process of stapling the sheet bundle.

As illustrated in FIG. 1, the post-processing device 150 includes two sheet discharging trays 151 and 152. The upper tray 151 has the sheets stacked thereon in a state where the sheets are delivered from the sheet discharging port 42. The lower tray 152 has the sheets stacked thereon in a state where the sheet bundle is evenly arranged or stapled.

[Inner Structure of Image Forming System]

Figure 2:
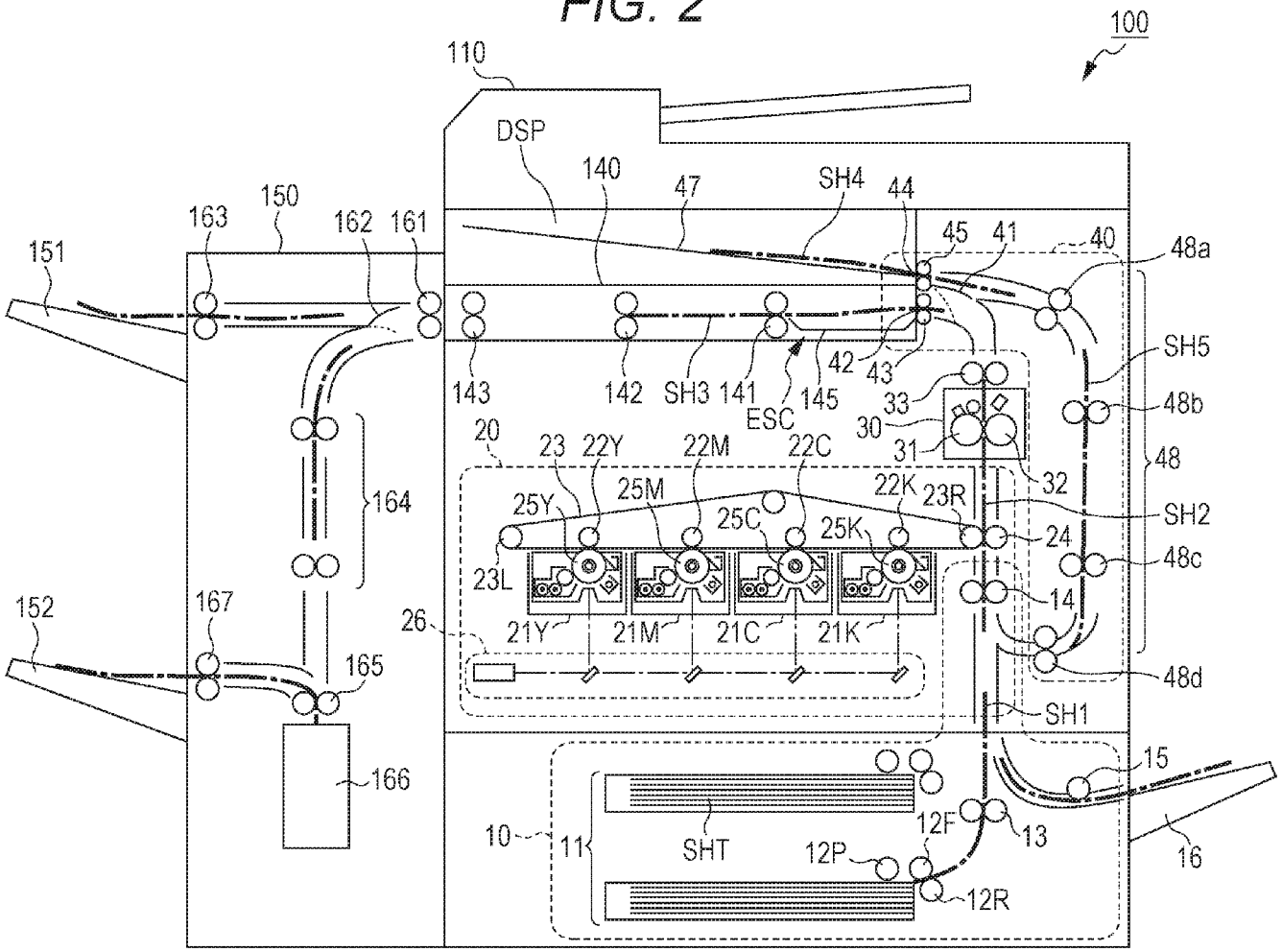
FIG. 2 is a front view schematically illustrating the inner structure of the image forming system.

FIG. 2 is a front view schematically illustrating the inner structures of the systems 100, 140, and 150 illustrated in FIG. 1. In FIG. 2, these inner components are depicted as if the casing is transparent. As illustrated in FIG. 2, the printer 130 includes a feeding part 10, an imaging part 20, a fixing part 30, and a delivering part 40. An image forming unit of the MFP 100 is realized by the combination of these components and a toner image is formed on the sheet based on image data.

The feeding part 10 feeds a sheet SH1 one by one to the imaging part 20 from a sheet bundle SHT stacked on a sheet feeding cassette 11 or a hand insertion tray 16 by the use of feeding roller groups 12P, 12R, 12F, 13, 14, and 15.

An example of the size of the sheet SHT received in the sheet feeding cassette 11 and the hand insertion tray 16 includes A3, A4, A5, or B4. The size of the sheet received in the sheet feeding cassette 11 and the hand insertion tray 16 is automatically detected by a sensor (not illustrated). By the detection of the size, a length Ls in the sheet conveying direction can be obtained. Further, the sheet feeding cassette 11 is able to receive a normal sheet therein and the hand insertion tray 16 is able to receive, for example, a thin sheet in addition to the normal sheet. As the thin sheet, a sheet of which the basis weight is smaller than a predetermined value, for example, 60 $g/m^2$ can be used.

The imaging part 20 forms a toner image on a sheet SH2 fed from the feeding part 10. Specifically, four imaging units 21Y, 21M, 21C, and 21K respectively first expose the surfaces of photosensitive drums 25Y, 25M, 25C, and 25K according to a pattern based on image data by using a laser beam emitted from an exposure part 26 and form electrostatic latent images on the surfaces thereof.

Next, the imaging units 21Y, 21M, 21C, and 21K develop the electrostatic latent images by the toner of yellow (Y), magenta (M), cyan (C), and black (K). The four color toner images are sequentially transferred onto the same position on the surface of an intermediate transfer belt 23 in a superimposed state from the surfaces of the photosensitive drums 25Y, 25M, 25C, and 25K by the electric field formed between each of the primary transfer rollers 22Y, 22M, 22C, and 22K and each of the photosensitive drums 25Y, 25M, 25C, and 25K. In this way, one color toner image is formed at the position.

The color toner image passes through a nip between the intermediate transfer belt 23 and the secondary transfer roller 24 along with the sheet SH2 fed from the feeding part 10 so that the color toner image is transferred onto the front surface of the sheet SH2 by the electric field formed between the intermediate transfer belt 23 and the secondary transfer roller 24. Subsequently, the secondary transfer roller 24 delivers the sheet SH2 toward the fixing part 30.

The fixing part 30 heat-fixes the toner image onto the sheet SH2 delivered from the imaging part 20. Specifically, when the sheet SH2 passes through a nip between a fixing roller 31 and a pressing roller 32, the fixing roller 31 applies heat of a heater provided therein to the front surface of the sheet SH2 and the pressing roller 32 presses the heating portion of the sheet SH2 against the fixing roller 31. Due to the heat of the fixing roller 31 and the pressure of the pressing roller 32, the toner image is fixed onto the front surface of the sheet SH2. Subsequently, a front sheet discharging roller 33 delivers the sheet SH2 toward the delivering part 40.

The delivering part 40 delivers the sheet SH2 delivered from the front sheet discharging roller 33 toward the relay unit 140 or reverses the sheet SH2 by the reversing tray 47. As illustrated in FIG. 2, the delivering part 40 includes a switching claw 41, the sheet discharging port 42, a sheet discharging roller 43, the reversing port 44, a reversing roller 45, and a circulation path 48. As for the rollers including the sheet discharging roller 43, a pair of rotation members rotates while the sheet is nipped therebetween so that the sheet is conveyed by a rotation force, but in the description below, the pair of rollers will be simply referred to as the roller unless otherwise specified.

The switching claw 41 is a claw-shaped or plate-shaped member of which a base end is rotatably fixed between the sheet discharging port 42 and the reversing port 44 and moves a front end thereof upward and downward while swinging about the base end. When the sheet delivered by the front sheet discharging roller 33 is delivered toward the relay unit 140, the switching claw 41 moves the front end upward so as to form a path (hereinafter, referred to as a "delivery path") toward the sheet discharging port 42. Then, when the sheet is reversed by the reversing port 44, the switching claw 41 moves the front end downward so as to form a path (hereinafter, referred to as a "reversing path") toward the reversing port 44. Each of the sheet discharging port 42 and the reversing port 44 is formed as a thin and elongated slit which is opened in the horizontal direction in the casing of the MFP 100 facing the gap DSP. The reversing port 44 corresponds to an opening of the casing so that an external space of the casing of the MFP 100 is used as a space for reversing the sheet conveying direction.

The sheet discharging roller 43 is disposed at the inside of the sheet discharging port 42 and rotates so as to deliver a sheet SH3 moved along the switching claw 41 from the sheet discharging port 42 toward the relay unit 140 by the peripheral surface. The reversing roller 45 is disposed at the inside of the reversing port 44 and is rotatable in both the normal and reverse rotation directions.

The reversing roller 45 first delivers a sheet SH4 moved along the switching claw 41 by the peripheral surface while rotating in the normal rotation direction from the reversing port 44 so that the sheet SH4 is placed on the reversing tray 47. The reversing roller 45 rotates reversely immediately before the tail end of the sheet SH4 passes therethrough so that the sheet SH4 is drawn from the reversing tray 47 into the reversing port 44, that is, the sheet SH4 is fed toward the circulation path 48 while the conveying direction is reversed.

In the circulation path 48, conveying rollers 48*a* to 48*d* return a sheet SH5 delivered by the reversing roller 45 toward the conveying route inside the feeding part 10 while the sheet is reversed. Here, the rotation direction in which each of the conveying rollers 48*a* to 48*d* conveys the sheet SH5 will be referred to as the normal rotation direction.

Subsequently, the feeding part 10 feeds the sheet SH5 to the imaging part 20 again and the imaging part 20 forms a toner image on a rear surface (a second surface) of the sheet SH5. The fixing part 30 performs a heat treatment on the sheet SH5 again and the delivering part 40 delivers the sheet SH5 toward the relay unit 140 at this time.

The relay unit 140 relays the sheet delivered from the sheet discharging port 42 toward the post-processing device 150 by the use of conveying roller groups 141, 142, and 143. In the sheet conveying route of the relay unit 140, an escape section ESC is included in a part from the sheet discharging port 42 of the printer 130 to the conveying roller 141.

In the escape section ESC, a guide plate 145 which has a surface recessed downward in a protruding manner is disposed at the lower side of a space formed between the sheet discharging roller 430 and the conveying roller 141 so that a sheet passes through the space. The guide plate 145 forms an expanded part which receives a sheet in a curved state in a space formed by expanding a part of the conveying route. Thus, the guide plate 145 has a function of receiving two stopped sheets in an overlapping state. The escape section ESC is used for the purging control to be described later.

The post-processing device 150 includes an entrance conveying roller 161, a branch claw 162, an upper sheet discharging roller 163, a conveying roller group 164, a reversing roller 165, a post-processing part 166, and a lower sheet discharging roller 167 in addition to the sheet discharging trays 151 and 152.

The entrance conveying roller 161 receives a sheet from the relay unit 140 and draws the sheet into the casing. The branch claw 162 is a claw-shaped or plate-shaped member of which a base end is rotatably fixed and moves a front end thereof upward and downward while swinging about the base end. When the sheet drawn by the entrance conveying roller 161 is delivered toward the upper sheet discharging roller 163, the branch claw 162 moves the front end downward so as to form a path toward the upper sheet discharging roller 163. Meanwhile, when the sheet is delivered toward the post-processing part 166, the branch claw moves the front end upward so as to form a path toward the conveying roller group 164.

The upper sheet discharging roller 163 is disposed near the base end of the upper sheet discharging tray 151 and discharges the sheet moved from the entrance conveying roller 161 along the branch claw 162 toward the upper sheet discharging tray 151. The conveying roller group 164 conveys the sheet moved from the entrance conveying roller 161 along the branch claw 162 to the reversing roller 165 in a direction toward the post-processing part 166.

The reversing roller 165 is disposed at the entrance of the post-processing part 166 and is rotatable in both the normal and reverse rotation directions. The reversing roller 165 first feeds the sheet delivered from the conveying roller group 164 toward the post-processing part 166 by the peripheral surface while rotating in the normal rotation direction. Next, the reversing roller 165 draws the sheet bundle subjected to the post-processing by the peripheral surface from the post-processing part 166 while rotating in the reverse rotation direction.

The post-processing part 166 performs post-processing including an arranging process and a stapling process on a bundle as a predetermined number of sheets fed from the reversing roller 165. The lower sheet discharging roller 167 is disposed near the base end of the lower sheet discharging tray 152 and discharges the sheet bundle drawn from the post-processing part 166 by the reversing roller 165 toward the lower sheet discharging tray 152.

[Sheet Conveying Part]

As illustrated in FIG. 2, in the MFP 100, a part of the imaging part 20 and the fixing part 30 including a driving roller 23R of the intermediate transfer belt 23, the secondary transfer roller 24, the fixing roller 31, the pressing roller 32, the front sheet discharging roller 33, and the like serve as a sheet conveying part other than the feeding part 10 and the delivering part 40.

Figure 3:
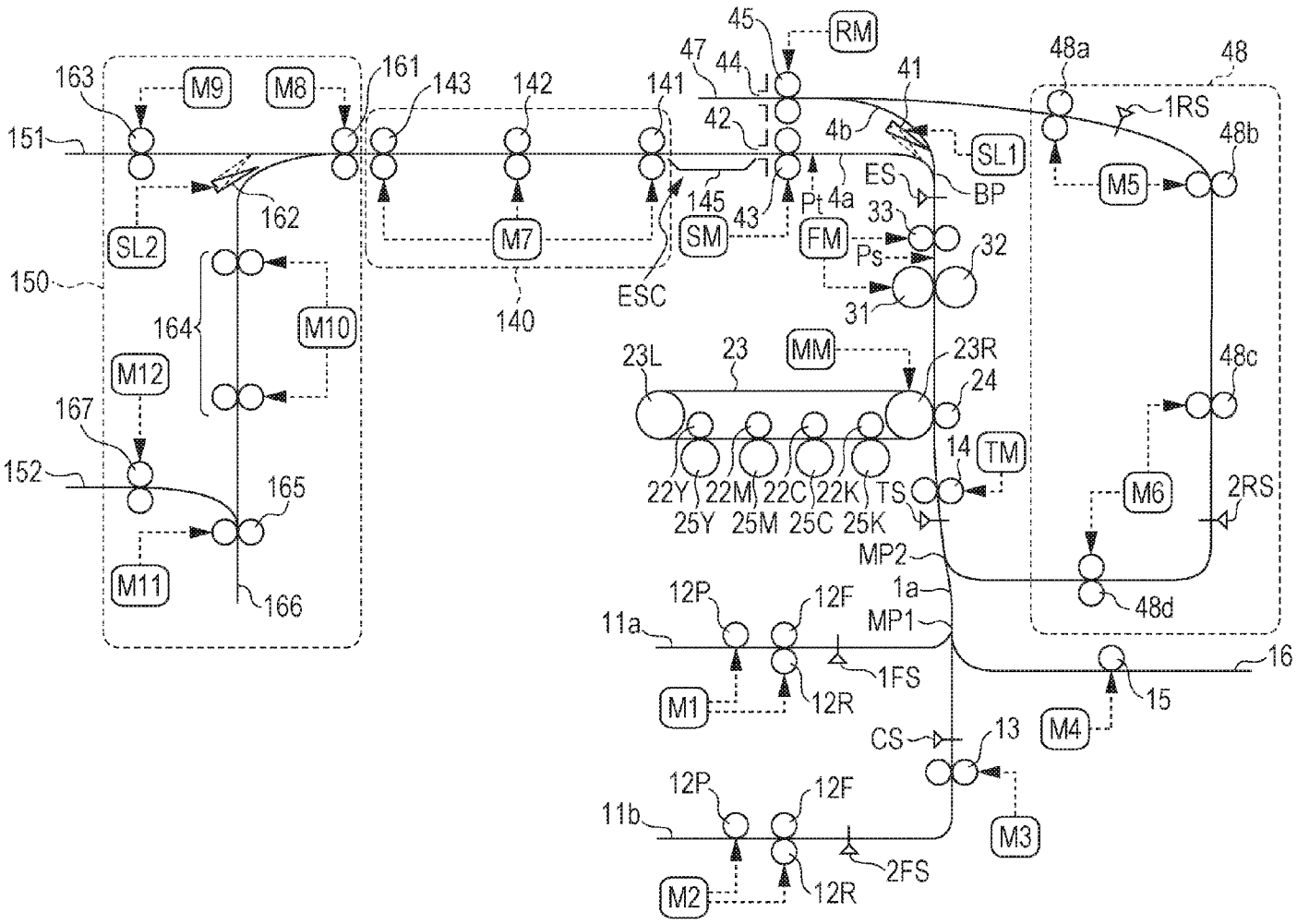
FIG. 3 is a schematic diagram illustrating a sheet conveying route which is formed by a conveying part of the image forming system.

FIG. 3 is a schematic diagram illustrating a sheet conveying route formed by the sheet conveying part.

As illustrated in FIG. 3, the route is formed as below. First, three sheet feeding routes extending from the sheet feeding cassettes 11*a* and 11*b* and the hand insertion tray 16 are combined into one route (hereinafter, referred to as a "conveying path") 1*a* at a first merging point MP1. The conveying path 1*a* passes through the imaging part 20 and the fixing part 30 and is divided into two routes, that is, a delivery path 4*a* and a reversing path 4*b* at a branch point BP facing the switching claw 41 of the delivering part 40.

The delivery path 4*a* is connected to the conveying route inside the relay unit 140 through the sheet discharging port 42, and the reversing path 4*b* is connected to the circulation path 48 by the reversing port 44. The circulation path 48 is connected to the conveying path 1*a* at a second merging point MP2 positioned near a timing roller 14. Hereinafter, a route such as a conveying path and a delivery path that conveys a sheet will be generally referred to as a conveying route.

In addition, the relay unit 140 is used to relay a sheet between the printer 130 and the post-processing device 150. However, when the post-processing device 150 is set as the device at the sheet conveying destination, the conveying route of the relay unit 140 can be recognized as a part of the delivery path 4*a* that delivers a sheet to the device at the sheet conveying destination. Hereinafter, the delivery path 4*a* also includes the conveying route of the relay unit 140.

Referring to FIG. 3 again, a plurality of optical sensors 1FS, 2FS, CS, TS, ES, 1RS, and 2RS is provided on these conveying routes in addition to the roller group 12P and the like illustrated in FIG. 2. The optical sensor 1FS and the like detect the sheet passing through the installation positions.

Specifically, each optical sensor includes a light emitting part and a light receiving part. The light emitting part emits a predetermined wavelength of light such as an infrared ray and the light receiving part detects the light of the wavelength. While one sheet passes through the installation position of each optical sensor, the sheet interrupts the light emitted from the light emitting part at the front side of the light receiving part or reflects the light toward the light receiving part. Since the output of the light receiving part changes in response to the interruption or the reflection of the emitted light, the sheet passing through the installation position of each optical sensor is detected. The detection result is transmitted from the feeding part 10, the delivering part 40, and the like to a main control unit 60 to be described later (see FIG. 5). In response to the detection result, the main control unit 60 determines whether the sheet conveying operation is normally performed without any jam or the sheet conveying timing is abnormal due to a jam as will be described below.

Sheet feeding sensors 1FS and 2FS are provided at the start end of the conveying route illustrated in FIG. 3, that is, the vicinity of the sheet feeding cassettes 11*a* and 11*b*. In response to the existence of the delay of the sheet passage timing indicated by the output, it is determined whether the feeding roller groups 12P, 12F, and 12R feed the sheets to the route at a normal timing.

In the route from the second sheet feeding cassette 11*b*, a longitudinal conveying sensor CS is provided at the front side of the first merging point MP1 in addition to a longitudinal conveying roller 13. In response to the existence of the delay of the sheet passage timing indicated by the output, it is determined whether the longitudinal conveying roller 13 delivers the sheets toward the first merging point MP1 at a normal timing.

In addition to the timing roller 14, a timing sensor TS is provided at the downstream side of any one of the first merging point MP1 and the second merging point MP2 in the vicinity of the boundary between the feeding part 10 and the imaging part 20. The timing roller 14 is generally stopped and also first stops the sheet moved from any one of the sheet feeding cassettes 11*a* and 11*b*, the hand insertion tray 16, and the circulation path 48. The timing roller 14 further starts to rotate at a timing indicated by the driving signal output from the main control unit 60 so as to deliver the stopped sheet toward the imaging part 20 at that timing.

In response to the existence of the delay of the sheet passage timing indicated by the output of the timing sensor TS, it is determined whether the sheet reaches the timing roller 14 at a normal timing or the sheet is delivered from the timing roller 14 at a normal timing. Further, the size of the sheet can be measured from the time necessary for the timing roller 14 to deliver each sheet.

A sheet discharging sensor ES is provided at the upstream side of the branch point BP. In response to the existence of the delay of the sheet passage timing indicated by the output, it is determined whether the front sheet discharging roller 33 delivers a sheet at a normal timing or the sheet discharging roller 43 or the reversing roller 45 draws a sheet at a normal timing.

The circulation path 48 is provided with conveying sensors 1RS and 2RS. In response to the existence of the delay of the sheet passage timing indicated by the output, it is determined whether the conveying rollers 48*a* to 48*d* of the circulation path 48 convey a sheet at a normal timing.

Although not illustrated in FIG. 3, a plurality of optical sensors is also provided in the conveying routes of the relay unit 140 and the post-processing device 150. The post-processing device 150 detects the position of the sheet currently conveyed on the route by using these sensors and transmits the detection result to the main control unit 60 of the MFP 100. Based on the detection result, it is determined whether the conveying timing is abnormal and a conveying error such as a jam occurs on the conveying routes of the relay unit 140 and the post-processing device 150.

When the jam occurring in the current conveyed sheet is detected, a current printing job or the like is interrupted. A user can solve the jam by opening or closing an outer cover (not illustrated) for the MFP 100, the relay unit 140, and the post-processing device 150 and manually removing the sheet stopped on the conveying route due to the jam. When the jam is solved, the interrupted job is resumed.

Referring to FIG. 3, driving motor groups M1 to M12, TM, MM, FM, SM, and RM of the roller group 12P and the like and driving solenoids SL1 and SL2 of the switching claw 41 and the branch claw 162 are provided in the periphery of the conveying route. Each of the motor M1 and the like is, for example, a DC brushless (BLDC) motor and is generally rotatable in both the normal and reverse rotation directions. Each of the motor M1 and the like applies a rotation force to a roller as a driving target through a transmission system including a gear, a belt, and the like. The solenoids SL1 and SL2 move movable iron cores (plunger) in the axial direction by using an electromagnet and press and pull the switching claw 41 and the branch claw 162 so as to swing the claws upward and downward.

In the vicinity of the sheet feeding cassettes 11*a* and 11*b*, the feeding motors M1 and M2 rotate the feeding roller groups 12P, 12F, and 12R. In the vicinity of the route extending from the second sheet feeding cassette 11*b*, the longitudinal conveying motor M3 rotates the longitudinal conveying roller 13. In the vicinity of the route extending from the hand insertion tray 16, the feeding motor M4 rotates the feeding roller 15.

In the vicinity of the boundary between the feeding part 10 and the imaging part 20, the timing motor TM rotates the timing roller 14. In the imaging part 20, the main motor MM rotates the driving roller 23R of the intermediate transfer belt 23. In the fixing part 30, the fixing motor FM rotates the fixing roller 31 and the front sheet discharging roller 33.

In the delivering part 40, the sheet discharging motor SM rotates the sheet discharging roller 43 and the reversing motor RM rotates the reversing roller 45 in both the normal and reverse rotation directions. Here, the rotation of the reversing motor RM during the normal rotation of the reversing roller 45 will be referred to as the normal rotation and the rotation of the reversing motor RM during the reverse rotation of the reversing roller 45 will be referred to as the reverse rotation. The switching solenoid SL1 swings the switching claw 41 upward and downward. In the circulation path 48, one motor M5 rotates front conveying rollers 48*a* and 48*b* and another motor M6 rotates rear conveying rollers 48*c* and 48*d*.

In the relay unit 140, the conveying motor M7 rotates the conveying roller group 141 and the like. In the post-processing device 150, the first motor M8 rotates the entrance conveying roller 161, the solenoid SL2 swings the branch claw 162 upward and downward, the second motor M9 rotates the upper sheet discharging roller 163, and the third motor M10 rotates the conveying roller group 164. The fourth motor M11 rotates the reversing roller 165 in both the normal and reverse rotation directions and the fifth motor M12 rotates the lower sheet discharging roller 167.

—Sheet Conveying Operation in Duplex Printing Mode—

The conveying part conveys a sheet from the sheet feeding cassettes 11*a* and 11*b* toward the post-processing device 150 through the image forming units 10, 20, 30, and 40 and the relay unit 140 by using the conveying roller group 12P and the like illustrated in FIG. 3. Particularly in the duplex printing mode, a sheet having an image printed on a front surface thereof is reversed by the reversing port 44 and is returned to the conveying path through the circulation path 48 while the sheet is reversed.

Figure 4A:
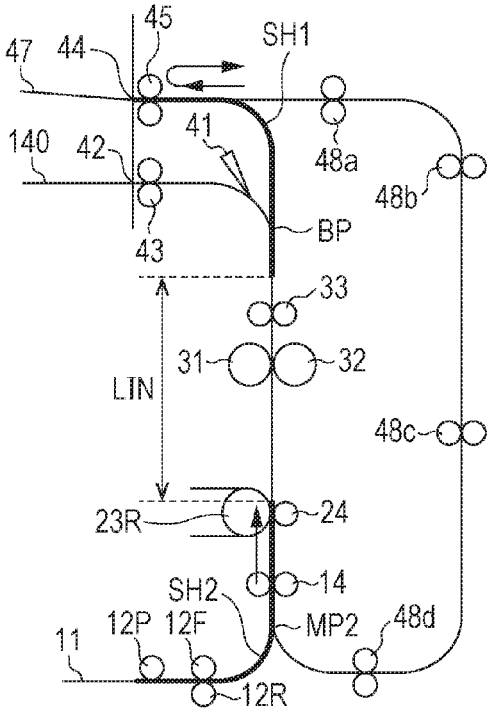
FIGS. 4A to 4D are schematic diagrams gradually illustrating a state where a sheet group is conveyed on the route in a duplex printing mode.
Figure 4B:
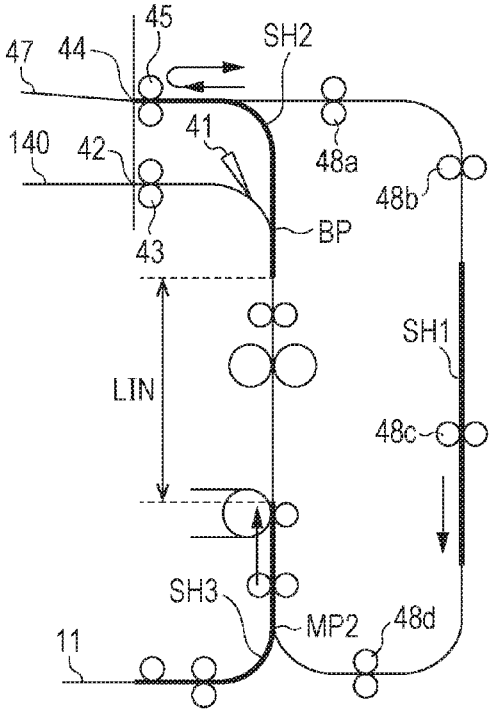
Figure 4C:
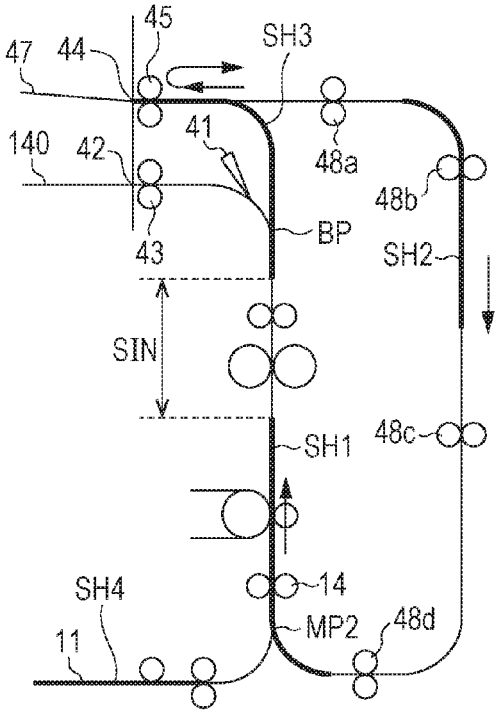
Figure 4D:
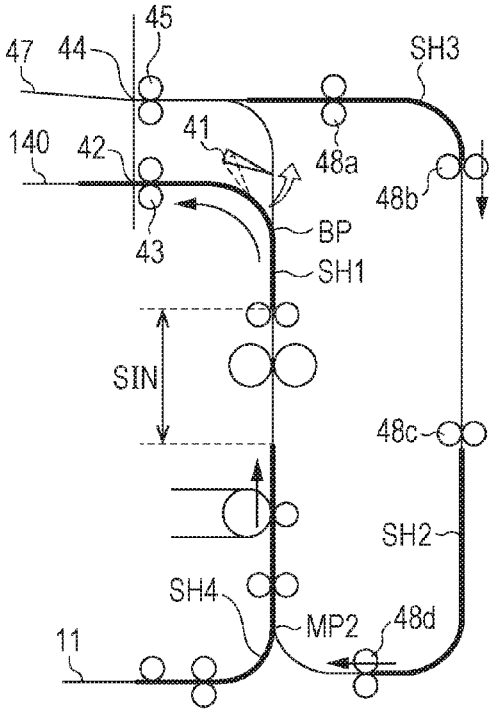

FIGS. 4A to 4D are schematic diagrams gradually illustrating a state where a sheet group is conveyed on the route in the duplex printing mode. FIG. 4A illustrates a state where an image is continuously printed on the front surfaces of the first two sheets SH1 and SH2, FIG. 4B illustrates a state where an image is printed on the front surface of the third sheet SH3, FIG. 4C illustrates a state where an image is printed on the rear surface of the first sheet SH1, and FIG. 4D illustrates a state where an image is printed on the front surface of the fourth sheet SH4.

As illustrated in FIG. 4A, the first two sheets SH1 and SH2 are continuously delivered from the sheet feeding cassette 11 toward the conveying path. At this time, since the switching claw 41 moves the front end downward so as to form the reversing path at the branch point BP in advance, the first sheet SH1 moves from the branch point BP toward the reversing port 44 along the reversing path so as to be reversed therein. The timing roller 14 delivers the next sheet SH2 so that a gap LIN between the leading end of the next sheet SH2 in the conveying direction and the tail end of the first sheet SH1 in the conveying direction becomes a predetermined gap. Particularly based on the sheet conveying speed of the conveying part, the gap LIN is set so that the next sheet SH2 reaches the reversing port 44 after the time point in which the reversing roller 45 delivers the first sheet SH1 from the reversing port 44 toward the circulation path 48. Hereinafter, the leading end in the sheet conveying direction will be referred to as the leading end of the sheet and the tail end in the sheet conveying direction will be referred to as the tail end of the sheet.

As illustrated in FIG. 4B, when the second sheet SH2 reaches the branch point BP, the switching claw 41 keeps the reversing path while moving the front end downward. Thus, the second sheet SH2 moves along the reversing path from the branch point BP toward the reversing port 44 so as to be reversed therein. Meanwhile, when the third sheet SH3 is delivered from the sheet feeding cassette 11 toward the conveying path, the timing roller 14 widens the gap LIN between the leading end of the third sheet SH3 and the tail end of the second sheet SH2 to a predetermined gap. Accordingly, the third sheet SH3 reaches the reversing port 44 after the time point in which the reversing roller 45 delivers the second sheet SH2 from the reversing port 44 toward the circulation path 48.

As illustrated in FIG. 4C, when the third sheet SH3 reaches the branch point BP, the switching claw 41 keeps the reversing path while moving the front end downward. Thus, the third sheet SH3 moves along the reversing path from the branch point BP to the reversing port 44 so as to be reversed therein. Meanwhile, when the first sheet SH1 is returned from the circulation path 48 to the second merging point MP2, the timing roller 14 delivers the first sheet SH1 fast by narrowing a gap SIN between the leading end of the first sheet SH1 and the tail end of the third sheet SH3 to a gap narrower than the gap LIN. Accordingly, the fourth sheet SH4 is movable on the conveying path earlier than the second sheet SH2.

As illustrated in FIG. 4D, the switching claw 41 moves the front end upward so as to switch the sheet conveying destination to the delivery path before the first sheet SH1 reaches the branch point BP. Thus, the first sheet SH1 is delivered from the sheet discharging port 42 toward the relay unit 140 along the delivery path extending from the branch point BP. Meanwhile, the fourth sheet SH4 is delivered from the sheet feeding cassette 11 toward the conveying path earlier than the time point in which the second sheet SH2 returns from the circulation path 48 toward the second merging point MP2. At this time, the timing roller 14 delivers the fourth sheet SH4 fast by narrowing the gap SIN between the leading end of the fourth sheet SH4 and the tail end of the first sheet SH1 to a gap narrower than the gap LIN and causes the second sheet SH2 to be movable on the conveying path.

In this way, the conveying part alternately conveys a sheet supposed to have an image printed on a front surface and a sheet supposed to have an image printed on a rear surface at an appropriate timing. Accordingly, since the contact of the sheets at the reversing port 44 is prevented, the reliability and the productivity of the MFP 100 are maintained highly.

[Electronic Control System of Image Forming System]

Figure 5:
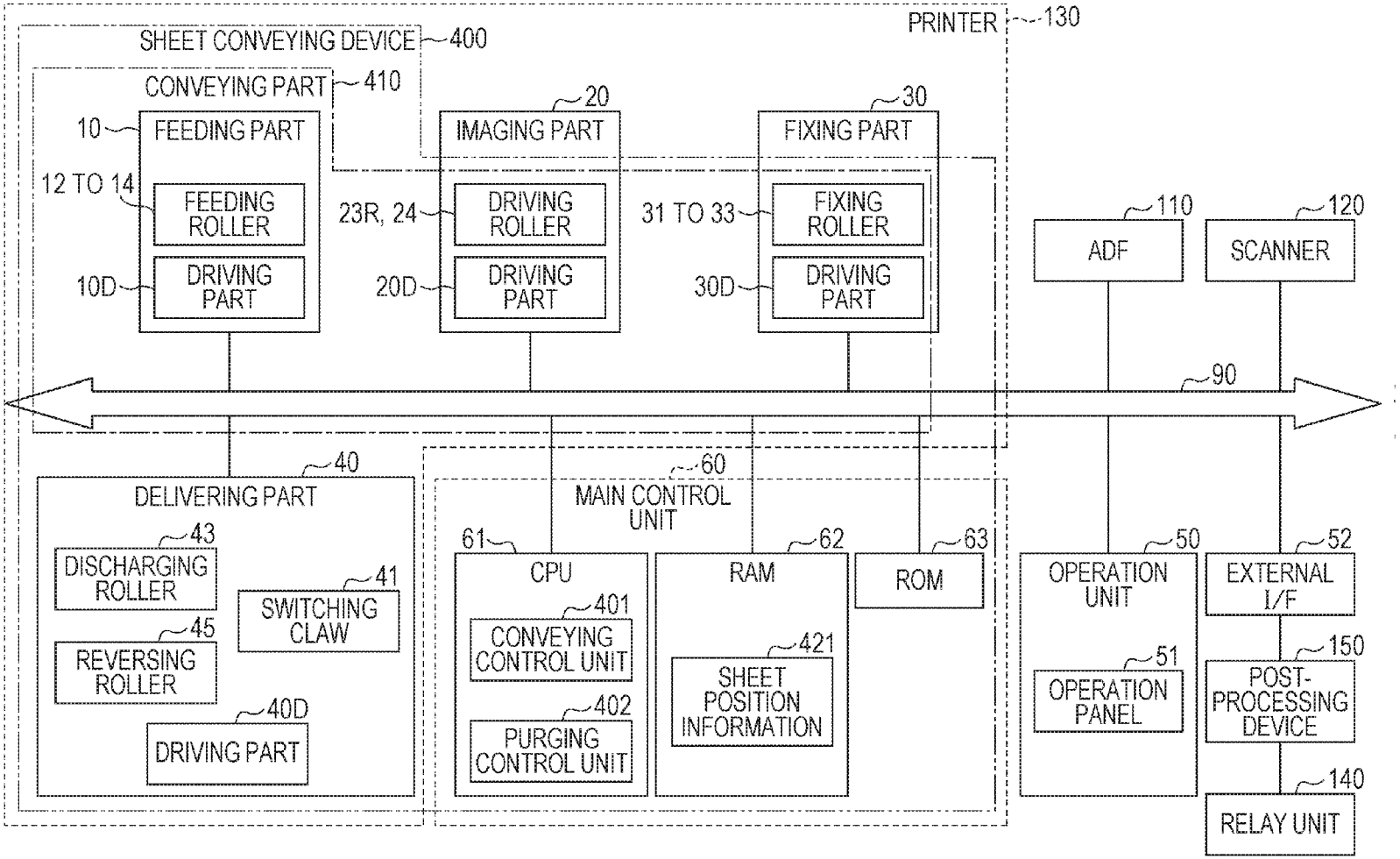
FIG. 5 is a block diagram illustrating the configuration of an electronic control system of a MFP.

FIG. 5 is a block diagram illustrating the configuration of the electronic control system of the MFP 100. As illustrated in FIG. 5, in the electronic control system, an operation unit 50, an external interface (I/F) 52, and the main control unit 60 are connected to one another via a bus 90 so as to communicate with one another in addition to the ADF 110, the scanner 120, and the printer 130.

—Operation Unit—

The operation unit 50 receives a requested job and image data of a printing target through the operation of the user or the communication with the external electronic device and transmits the requested job and the image data to the main control unit 60. As illustrated in FIG. 5, the operation unit 50 includes an operation panel 51. As illustrated in FIG. 1, the operation panel 51 is provided at the front surface of the casing of the MFP 100 and includes a push button, a touch panel, and a display.

The operation unit 50 controls the operation panel 51 so as to display a GUI screen including an operation screen and an input screen for various parameters on the display. Further, the operation unit 50 identifies the position of the push button or the touch panel operated by the user and transmits the identification information as operation information to the main control unit 60. The input information includes, for example, the setting of the type of sheet (which may be a normal sheet, a thin sheet, or the like) received in the sheet feeding cassette 11 or the hand insertion tray 16 and the designation of the number of the sheets to be staple-bound. Further, the display screen includes a message indicating a state where a jam (paper jam) occurs in the current conveyed sheet.

—External I/F—

The external I/F 52 includes a USB port or a memory card slot and directly takes image data of a printing target from an external storage device such as a USB memory or a hard disk drive (HDD) therethrough. Also, the external I/F 52 is connected to an external network (which is not illustrated in FIG. 5) in a wired or wireless state and receives image data of a printing target from other electronic devices on a network. Further, the external I/F 52 is connected to the electronic control system of the post-processing device 150 so as to relay data between the electronic control system and the main control unit 60.

—Main Control Unit—

The main control unit 60 is an electronic circuit mounted on one substrate and the substrate is provided inside the MFP 100. As illustrated in FIG. 5, the main control unit 60 includes a CPU 61, a RAM 62, and a ROM 63. The CPU 61 controls the other components 10, 20, and the like connected to the bus 90 according to firmware. The RAM 62 provides a working area for executing the firmware by the CPU 61 for the CPU 61 and stores the image data of the printing target received by the operation unit 50. The ROM 63 includes a non-writable semiconductor memory device and a writable semiconductor memory device such as an EEPROM or a HDD. The former stores firmware and the latter provides a storage area for an environment variable for the CPU 61.

When the CPU 61 executes various kinds of firmware, the main control unit 60 controls other components inside the MFP 100 based on the operation information from the operation unit 50. Specifically, the main control unit 60 receives a user's operation by displaying an operation screen on the operation unit 50. In response to the operation, the main control unit 60 determines an operation mode such as an operating mode, a standby mode, and a sleep mode, notifies the operation mode to other components by a driving signal, and performs a process in response to the operation mode for each component.

For example, when the operation unit 50 receives a printing job from the user, the main control unit 60 first transmits the image data of the printing target in the operation unit 50 to the RAM 62. Next, the main control unit 60 designates the type and the feeding timing of the sheet to be fed in the feeding part 10 in accordance with the printing condition indicated by the job, provides image data indicating a toner image to be formed for the imaging part 20, designates the surface temperature to be kept of the fixing roller 31 in the fixing part 30, and designates the sheet conveying destination and the switching timing at the branch point BP in the delivering part 40.

Further, the main control unit 60 monitors the operation state or the sheet conveying state of each of the components 10, 20, and the like of the MFP 100. Then, when a problem in any one of the components is detected, the operation mode is appropriately changed so as to solve the problem. For example, when the abnormal delay of the sheet conveying timing is detected by the optical sensor 1FS and the like illustrated in FIG. 3, the process of the printer 130 is interrupted and a message indicating the "occurrence of the jam" is displayed on the operation panel 51 so that the user can promptly solve the problem. When the paper pieces of the sheet feeding cassettes 11*a* and 11*b* or the insufficient toner amounts of the imaging unit 21Y and the like are detected, the process of the printer 130 is interrupted and a message indicating a "state where paper is torn and toner is not sufficient" is displayed on the operation panel 51 so that the user replenishes the paper and the toner.

As illustrated in FIG. 5, the main control unit 60 includes a conveying control unit 401 and a purging control unit 402. The function units 401 and 402 are realized when the CPU 61 executes dedicated firmware. That is, the function units 401 and 402 constitute a sheet conveying device 400 of the MFP 100 along with the conveying part 410. The conveying control unit 401 controls the operation of the sheet conveying device 400 in the normal job. The purging control unit 402 purges the sheet conveying device 400 when the process of the printer 130 is interrupted in response to a problem such as a jam. The function units 401 and 402 will be described in detail later.

—Printer—

As illustrated in FIG. 5, the components 10, 20, 30, and 40 of the printer 130 respectively include driving parts 10D, 20D, 30D, and 40D. The driving part 10D and the like control the motor M1 and the like along with the solenoid SL1 for driving various movable members included in the conveying part 410 in addition to the conveying roller group 12P and the like.

Further, the driving parts 10D, 20D, and the like monitor the operation state and the sheet conveying state of the components 10, 20, and the like of the MFP 100 by using various sensors and transmits a detection result to the main control unit 60. These sensors include a position sensor which detects the position or the posture of each of the photosensitive drum 25Y and the like as well as the movable member like the fixing roller 31, a sensor which detects the paper pieces of the sheet feeding cassettes 11*a* and 11*b*, and a sensor which detects the insufficient toner amounts of the imaging unit 21Y and the like in addition to the optical sensor 1FS and the like illustrated in FIG. 3.

[Conveying Control Unit]

The conveying control unit 401 controls the driving parts 10D, 20D, and the like as below in response to the operation mode and the job condition of the MFP 100 and conveys an appropriate sheet to the conveying part 410 at an appropriate timing.

The conveying control unit 401 first instructs the driving part 10D of the feeding part 10 to select a sheet feeding cassette as a sheet feeding source and to pick up a sheet by the feeding rollers 12P, 15, and the like from the sheet feeding cassette at a certain timing. In response to the instruction, the conveying control unit 401 causes each of the driving part 10D and the like to monitor each sheet conveying state of the feeding part 10 so as to particularly track a position on the conveying route. Specifically, the conveying control unit 401 measures an elapse time from a time point in which a sheet is picked up by the feeding rollers 12P, 15, and the like by the use of a timer.

Since a standard value (that is, a system speed) is defined in the sheet conveying speed in accordance with each operation mode, the conveying control unit 401 periodically, for example, every several tens to several hundreds of milliseconds calculates each sheet movement distance based on the standard conveying speed and the elapse time from the pickup time point and calculates the position of the sheet at the current time point based on the value. The conveying control unit 401 stores the information on the position of each sheet calculated in this way in the RAM 62 as one item of sheet position information 421. The sheet position information 421 defines, for example, the sheet items in accordance with the conveying order.

Further, the conveying control unit 401 predicts a passage time in which each sheet passes through the installation positions of the optical sensor 1FS and the like based on the sheet position information 421. The conveying control unit 401 corrects the position of the sheet at the current time point based on an error between the prediction time and the actual passage time indicated by the output of the optical sensor and updates the position information 421 by the corrected value.

Next, the conveying control unit 401 instructs a delivery timing to the driving part 10D of the feeding part 10 so that the sheet in the timing roller 14 is delivered to the imaging part 20 and instructs a switching timing to the driving part 40D of the delivering part 40 so that the front end of the switching claw 41 is switched and the normal rotation of the reversing roller 45 is switched to the reverse rotation by using the sheet position information 421.

The conveying control unit 401 further detects the abnormal delay of the sheet conveying timing caused by a conveying error such as a jam based on the sheet position information 421, the output of the driving part 10D and the like, and the output of the optical sensor 1FS and the like. A case of the abnormal delay includes, for example, a case where an error between the passage time of the installation position of each of the optical sensor 1FS and the like predicted from the position information 421 and the actual passage time indicated by the output of the optical sensor exceeds an allowable range. In this case, even when the elapse time from the predicted passage time exceeds the allowable range, the output of the optical sensor does not indicate the actual passage of the sheet.

[Purging Control Unit]

The main control unit 60 performs purging by activating the purging control unit 402 when the process of the printer 130 is interrupted. The "purging operation" indicates an operation in which the conveyable sheet of the current conveyed sheets is automatically discharged from the conveying route. The purging destination is not limited to an original sheet discharging destination such as a sheet discharging tray, and each sheet can be discharged to each sheet discharging destination. As the reason of interrupting the process of the printer 130, for example, the following cases include: (1) a case where an instruction of stopping a job is transmitted from the user or an external device, (2) a case where the conveying control unit 401 detects a conveying error such as a jam or multi-feeding that occurs in any one of the components 10, 40, and the like of the conveying part 410, (3) a case where a conveying error such as a jam is notified from the post-processing device 150, and (4) a case where a problem such as paper pieces and insufficient toner or a problem in the components or sheets is notified from the components of the MFP 100.

In such a case, the purging control unit 402 first specifies the conveyable sheet located at the upstream side of the sheet which cannot be conveyed due to a jam or the like as a purging target from the sheet position information 421 and then determines the purging destination and the conveying order of each sheet. Then, the conveying part 410 continuously conveys to discharge these sheets to the purging destination according to the conveying order. Accordingly, since the conveyable sheet is removed from the conveying route, it is possible to promptly resume the process of the printer 130 after a problem interrupting the printing process or the like is solved in a manner such that the user removes the jammed sheet.

When a jam is detected inside the post-processing device 150, the reversing tray 47 of the MFP 100 is left as only the sheet discharging destination in the conveying route illustrated in FIG. 3. Thus, the purging control unit 402 sets the reversing tray 47 as a purging destination.

When there is a sheet B which is conveyed toward the relay unit 140 and currently passes through the branch point BP at the jam detection time point of the sheet A inside the post-processing device 150, the purging control unit 402 continuously conveys the sheet B and the sheet C currently conveyed inside the printer 130. Here, the sheet B is retracted toward the delivery path 4*a* so as to be conveyed to the relay unit 140. Then, after the tail end of the sheet B passes through the branch point BP, the sheet C is conveyed from the conveying path 1*a* to the reversing port 44 through the branch point BP and is purged outward from the reversing port 44 while not being reversed.

—Example of Purging Control—

Figure 6:
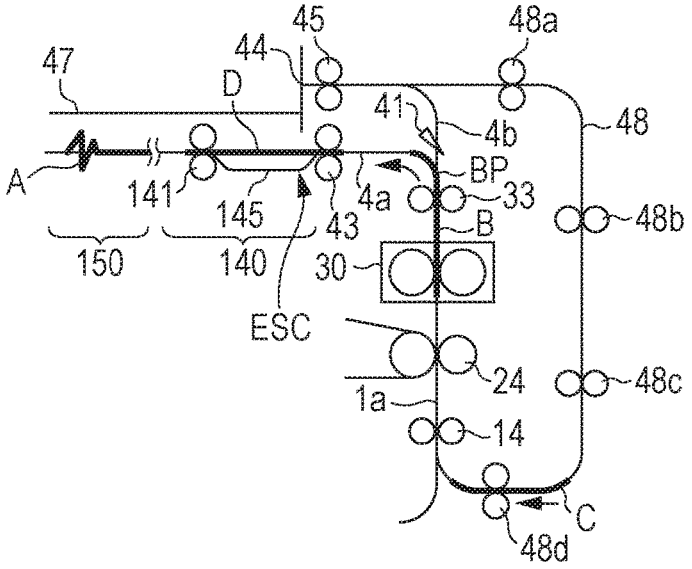
FIG. 6 is a schematic diagram illustrating the positions of sheets conveyed inside a relay unit and a printer at a time point in which a jammed sheet is detected in a post-processing device.

FIG. 6 is a schematic diagram illustrating the positions of sheets B to D conveyed inside the relay unit 140 and the printer 130 at the jam detection time point of the sheet A in the post-processing device 150. When the detection of the jam is notified from the post-processing device 150, the main control unit 60 interrupts the processes of the relay unit 140 and the printer 130 and activates the purging control unit 402.

The purging control unit 402 reads the sheet position information 421 from the RAM 62 and specifies the positions of three sheets B to D conveyed on the route at the current time point.

In FIG. 6, the sheets B to D are all duplex printing targets. At the detection time point of the jam JM, the sheet D having an image printed on the front and rear surfaces is conveyed inside the relay unit 140 toward the post-processing device 150, the sheet B having an image printed on the rear surface currently passes through the branch point BP toward the relay unit 140, and the sheet D having an image printed on the front surface is reversed and is conveyed on the circulation path 48. Further, FIG. 6 illustrates an example of a case where only the sheet C is conveyed on the circulation path 48. However, for example, there is a case in which a different sheet E subsequently following the sheet C is conveyed on the circulation path 48 while a gap is formed between the sheets C and E depending on a job.

Since the sheet B currently passes through the branch point BP toward the relay unit 140 and the conveying destination of the sheet B is the delivery path 4*a* at the jam detection time point, the switching claw 41 forms a delivery path by moving the front end thereof upward.

The purging control unit 402 specifies the positions of the sheets B to D from the position information 421 at the jam detection time point and checks the following items. First, it is checked whether the sheet D passes through the branch point BP and reaches the relay unit 140. It is checked whether the sheet B passes through the branch point BP toward the relay unit 140. It is checked whether the sheet conveying direction cannot be reversed at the delivery path 4*a* or the relay unit 140. Thus, it is checked whether the sheets D and B cannot be conveyed to the reversing tray 47. Meanwhile, it is checked whether the sheet C can be conveyed to the reversing tray 47 without the interference of the jam JM.

The purging control unit 402 specifies only the sheet C among the actually conveyed sheets B to D as a sheet purging target and continuously conveys the sheet B passing through the branch point BP and the sheet C as the purging target to the conveying part 410 and the delivering part 40. Then, the conveying operation of the sheet D conveyed in the relay unit 140 is stopped and the sheet B is retracted to the delivery path 4*a* while being caused to pass through the branch point BP.

Specifically, the rotation of the conveying rollers 141 to 143 of the relay unit 140 is stopped. Further, the rotation of the sheet discharging roller 43 is continued. Accordingly, the leading end of the sheet D in the sheet conveying direction is nipped between the pair of stopped conveying rollers 141 so that the advancing operation of the sheet is disturbed. Meanwhile, the tail end of the sheet in the sheet conveying direction is conveyed by the conveying force of the pair of sheet discharging rollers 43 so that the sheet is pressed into the escape section ESC. As a result, the sheet D takes a posture in which the leading end is stopped and the tail end is bent along the guide plate 145 of the escape section ESC.

When the tail end of the sheet D passes through the sheet discharging roller 43, the sheet D is stopped while being bent along the guide plate 145 in that the conveying force generated by the sheet discharging roller 43 is not applied to the sheet D. Since the rotation of the sheet discharging roller 43 is continued, the sheet B is continuously conveyed inside the relay unit 140 by the sheet discharging roller 43.

Figure 7A:
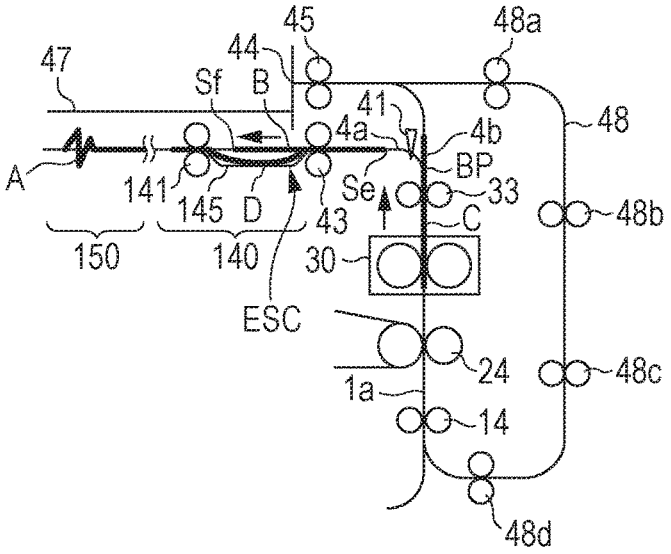
FIGS. 7A and 7B are schematic diagrams illustrating a state where a sheet is conveyed during a purging control.

FIG. 7A is a schematic diagram illustrating a state where the sheet B passes through the branch point BP and the leading end of the sheet B is conveyed into the relay unit 140 while the sheet D is stopped inside the relay unit 140.

Due to the continuous rotation of the sheet discharging roller 43, the leading end Sf of the sheet B conveyed into the relay unit 140 cannot advance due to the contact with the stopped conveying roller 141 and the tail end thereof is conveyed by the conveying force of the sheet discharging roller 43. Accordingly, the leading end of the sheet B is pressed into the escape section ESC.

The purging control unit 402 stops the rotation of the sheet discharging roller 43 when the tail end Se of the sheet B passes through the branch point BP. Accordingly, the sheet B is retracted to the delivery path 4*a* and is stopped in the escape section ESC so as to overlap a part of the sheet D. Due to this configuration, the escape section ESC can be regarded as an area in which two sheets can stay in an overlapping state. When there is the sheet B currently passing through the branch point BP toward the post-processing device 150 at the jam detection time point, the continuous conveying operation of the sheet B until the tail end Se of the sheet B passes through the branch point BP is regarded as the retraction of the sheet B to the delivery path 4*a*.

Further, the purging control unit 402 switches the front end of the switching claw 41 from the upper position to the lower position when the tail end Se of the sheet B passes through the branch point BP. Accordingly, the switching claw 41 forms the reversing path 4*b*. This operation indicates a state where the sheet conveying destination from the branch point BP by the switching claw 41 is not switched to the delivery path 4*a* as the original conveying destination for the subsequent sheet C. Since the sheet conveying destination from the branch point BP is switched to the reversing port 44, the sheet C reaching the branch point BP at the first time can advance to the reversing port 44.

Figure 7B:
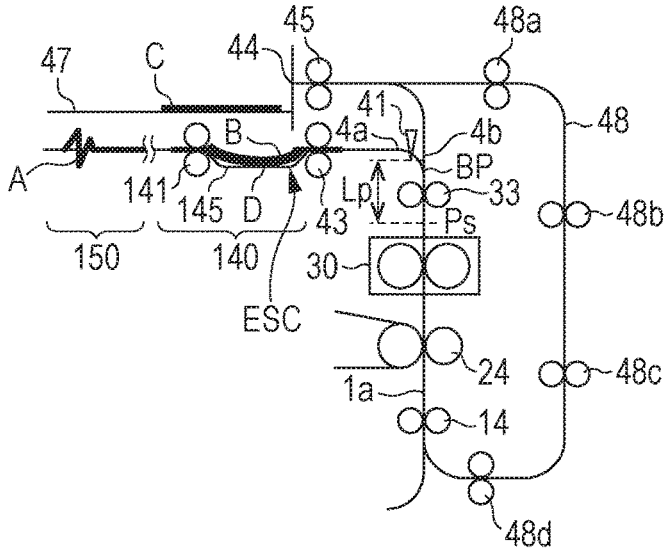

FIG. 7B is a schematic diagram illustrating a state where the sheet B is retracted to the delivery path 4*a* and the sheet C is purged outward from the reversing port 44 so as to be placed on the reversing tray 47.

In this way, when the sheet B currently passing through the branch point BP toward the relay unit 140 is not immediately stopped at the jam detection time point and is retracted to the delivery path 4*a*, the sheet B does not block the conveying route from the branch point BP to the reversing port 44 and the sheet C reaching the branch point BP subsequently after the retraction of the sheet B is conveyed to the reversing port 44 through the branch point BP so as to be purged outward from the reversing port 44. In addition, when there is the different sheet E subsequently after the sheet C as described above, the sheets can be purged in order of the sheet C and the sheet E.

A user needs to remove the jammed sheet A and the sheets B and C staying in the escape section ESC by opening or closing an outer cover, but can remove the sheet C (or the sheets C and E) stacked on the reversing tray 47 by stretching out a hand toward the reversing tray 47 even when the outer cover is not opened or closed. Accordingly, it is possible to reduce the effort of the user in the jam removing operation compared with the case where all sheets stopped at different positions inside the apparatus are removed one by one while the outer cover is opened or closed.

When the sheet B currently passing through the branch point BP is retracted to the delivery path 4*a*, the conveying rollers 141 to 143 are stopped at the jam detection time point while the rotation of the sheet discharging roller 43 is continued so that the further advancing operation of the sheet D is prohibited. Accordingly, it is possible to prevent a problem in which a new jam occurs due to the contact between the jammed sheet A and the subsequent sheet D.

Meanwhile, when the tail end of the sheet D is still conveyed by the sheet discharging roller 43, the advancing operation of the leading end of the sheet D is disturbed and the tail end of the sheet is conveyed by the conveying force of the sheet discharging roller 43. Accordingly, a pressing force is applied to the sheet D from both front and rear sides inside the relay unit 140. However, since the sheet D is bent inside the escape section ESC, the force disappears in the bending direction. Accordingly, the sheet is hardly bent or wrinkled.

Further, since the escape section ESC is provided, the bending of the sheet B is allowed. Accordingly, the purging control can be performed even when the sheet which is elongated in the conveying direction is used.

Specifically, the length Ls of the sheet B in the conveying direction needs to satisfy Equation 1 below in order to retract the sheet B to the delivery path 4*a* while the conveying roller 141 is stopped.

$$L1<Ls<(L1+L2+L3) \quad \text{(Equation 1)}$$

Here, L1 indicates a distance (see the enlarged view of FIG. 15) between the conveying roller 141 and the sheet discharging roller 43 on the conveying route, L2 indicates a distance from the branch point BP to the sheet discharging roller 43 on the conveying route, and L3 indicates an amount in which a maximal bent amount obtained when a straight sheet is bent downward along the guide plate 145 is converted into a length in the sheet conveying direction.

Here, the value of L3 will be described in detail. For example, L3 is constant in the distance of the conveying route from a position Pt illustrated in FIG. 3 to the sheet discharging roller 43. On the assumption that the length of one sheet Z in the conveying direction is constant in the value (L1+L3), the value of L3 can be expressed as a value satisfying a relation in which the tail end of the sheet Z is located at the same position as the sheet discharging roller 43 when the leading end of the sheet Z conveyed by the rotation of the sheet discharging roller 43 contacts the stopped conveying roller 141 and the leading end of the sheet Z is bent downward so that the entire sheet Z is bent along the guide plate 145.

When the relation of Ls≥(L1+L2+L3) is satisfied, the sheet B is bent by the maximal bent amount while the leading end of the sheet B contacts the stopped conveying roller 141 and the tail end thereof is located at the branch point BP. Accordingly, there is a concern that the switching operation of the switching claw 41 cannot be performed normally. When the switching operation of the switching claw 41 cannot be performed normally, the sheet C cannot be purged normally. In this case, the purging operation for the sheet C is prohibited and the conveying operation of the sheet C is interrupted. Accordingly, Equation 1 corresponds to a condition in which the purging operation for the sheet C is allowed or prohibited.

Since the value of L3 is defined by the width (the allowed bent amount) of the escape section ESC, it is possible to ensure a maximum length of Ls by providing the escape section ESC compared with a configuration in which the escape section ESC is not provided. Accordingly, the purging control can be performed even when the sheet B which is elongated in the conveying direction is used.

FIGS. 6 and 7 illustrate a state where the distance of the delivery path 4*a* from the branch point BP to the sheet discharging roller 43 or the distance of the reversing path 4*b* to the reversing port 44 is long in order to easily understand the sheet conveyed on the conveying route. However, the distance may be short as illustrated in FIG. 2. The escape section ESC is particularly useful for such a configuration.

In the description above, a case has been described in which a duplex printing operation is performed, but the purging operation can be also performed in a case where an image is printed on one surface. That is, in FIG. 6, the sheets A, D, and B are sheets each having an image printed on one surface. When the sheet C is switched to the sheet fed from the sheet feeding cassette 11, the sheet can be purged outward from the reversing port 44.

Further, in the description above, a case has been described in which the conveying operation of the sheet D existing between the jammed sheet A and the sheet B passing through the branch point BP is stopped when the jam occurring in the post-processing device 150 is detected, but the present invention is not limited thereto.

For example, when the time taken until the currently conveyed sheet D reaches the stop position of the jammed sheet A is denoted by ta, it is possible to prevent a new jam caused by the collision between the sheet D and the sheet A even when the sheet D is continuously conveyed by a time ta1 shorter than a time ta. Here, the sheet D is conveyed only by the time ta1 and the conveying operation of the sheet D is stopped. Specifically, the rotation of the conveying rollers 141 to 143 can be stopped.

In this way, the sheet D can be stopped while being conveyed to the further downstream side compared with the case where the conveying roller 141 is stopped at or immediately after the jam detection time point. Accordingly, since the time taken until the stop of the conveying roller 141 is delayed, the sheet B on the delivery path 4*a* can be stopped while being conveyed toward the further downstream side. If the sheet B can be conveyed to the further downstream side, the tail end of the sheet can be removed from the branch point BP even in the case of the sheet which is elongated in the conveying direction. Thus, the possibility of purging the sheet C increases.

The time ta can be obtained by obtaining the distance on the conveying route between the current positions of both sheets A and D on the conveying route and dividing the obtained distance by a sheet conveying speed (a predetermined system speed).

Then, on the assumption that the sheet B currently passing through the branch point BP toward the relay unit 140 is conveyed by the time ta1 from the current position on the conveying route, the purging operation for the sheet C may be allowed when the tail end of the sheet B is located at the downstream side of the branch point BP and the purging operation may not be allowed in the other cases.

In FIGS. 7A and 7B, the conveying destination of the sheet C is switched from the delivery path 4*a* to the reversing port 44 by the operation of the switching claw 41 after the tail end Se of the sheet B passes through the branch point BP. Incidentally, when a certain time Ts (for example, about 1 second) is necessary for switching the conveying destination of the switching claw 41 and the sheet gap (the paper gap) between the sheets B and C is not large, the switching operation may not be completed, that is, the switching operation may be late until the sheet C reaches the branch point BP.

When the conveying destination of the switching claw 41 is switched late, the purging operation for the sheet C is prohibited and the sheet C can be conveyed and retracted to the delivery path 4*a* while the conveying destination of the sheet C is set to the delivery path 4*a*.

Then, when there is the sheet E reaching the branch point BP subsequently after the sheet C, the sheet E can be purged in a manner such that the conveying destination of the sheet E is switched to the reversing port 44 by the switching claw 41 until the leading end of the sheet E reaches the branch point BP after the tail end of the sheet C conveyed to the delivery path 4*a* passes through the branch point BP.

It is possible to determine whether the conveying destination is switched in time by the switching claw 41 as below. That is, the sheet conveying speed V is constant as the system speed. Accordingly, as illustrated in FIG. 7B, when a position located at the upstream side in the conveying direction by a distance Lp (=V×Ts) from the branch point BP is denoted by Ps, the switching operation can be switched in time if the current position of the leading end of the sheet is the upstream position of the position Ps in the conveying direction at the jam detection time point. This condition is used as a switching condition. When the switching condition is satisfied, it is possible to purge the sheet C reaching the branch point BP at the first time after the tail end of the sheet B passes through the branch point BP as well as the subsequent sheets reaching the branch point BP.

Further, in FIGS. 6 and 7A and 7B, a case has been described in which the sheet B passing through the branch point BP and the sheet C subsequently reaching the branch point BP exist inside the printer 130 at the jam detection time point of the sheet A, but the present invention is not limited thereto.

Depending on the configuration of the apparatus, for example, there is a case in which the different sheet E currently conveyed on the circulation path 48 and the sheet F or the like currently reversed by the reversing roller 45 may exist during the duplex printing job as described above in addition to the sheets B and C at the jam detection time point of the sheet A. In this case, the sheets C, E, and F are specified as the sheet purging targets and are guided from the branch point BP to the reversing port 44 so as to be purged outward from the reversing port 44 according to the conveying order, that is, the order of the sheet C reaching the branch point BP at the first time, the sheet E reaching the branch point BP at the next time, and the sheet F reaching the branch point BP at the last time.

<Sheet Conveying Control of Duplex Printing Job>

Figure 8:
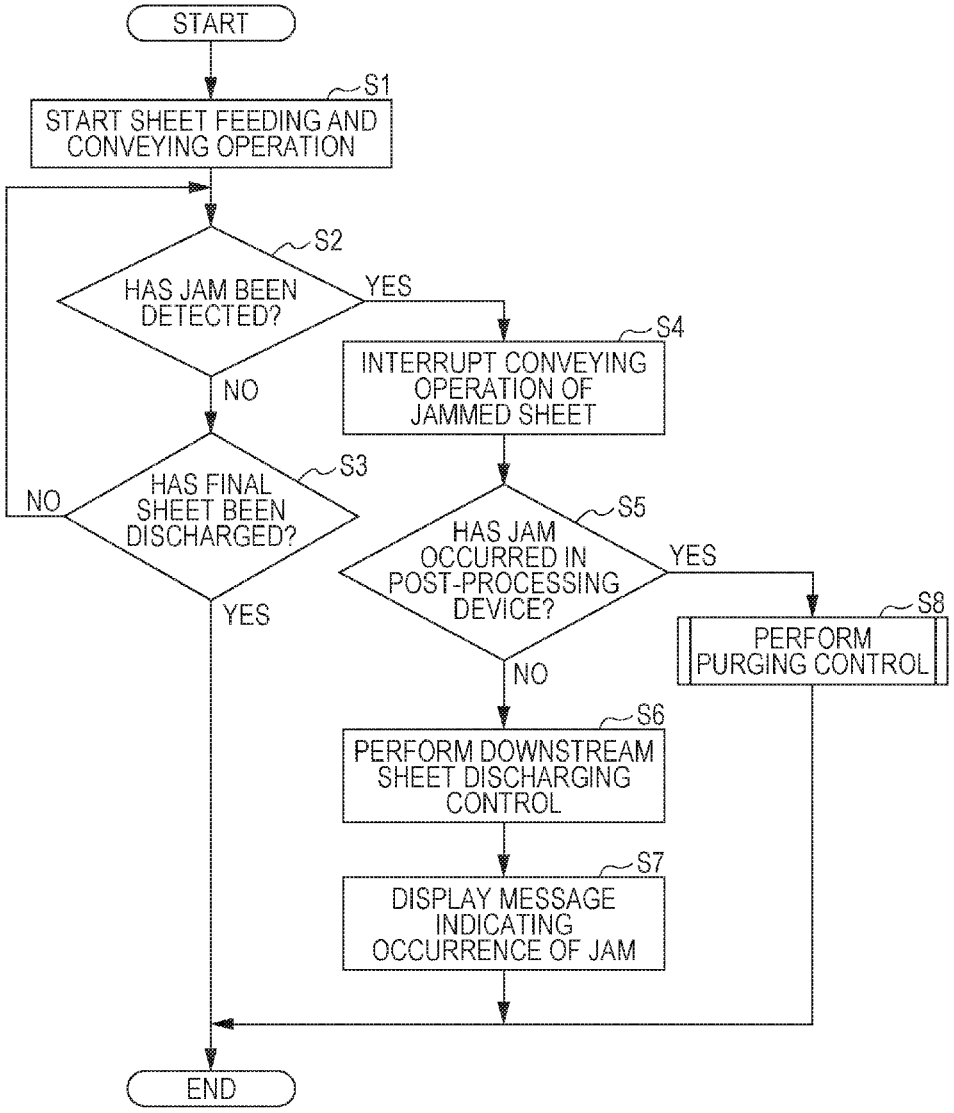
FIG. 8 is a flowchart illustrating the content of a sheet conveying control of a duplex printing job.

FIG. 8 is a flowchart illustrating an example of a sheet conveying control of a duplex printing job in which a plurality of sheets SH is fed one by one and a duplex printing process is performed on each sheet. The control is performed by the main control unit 60 by the unit of the printing job. In addition, the duplex printing job is a job not subjected to the post-processing.

A sheet feeding and conveying operation is started which feeds and conveys a plurality of sheets one by one from the sheet feeding cassette 11 or the hand insertion tray 16 (step S1).

The sheet feeding and conveying operation is performed according to the timing determined in advance for each sheet, for example, the sheet gap with respect to the precedent sheet when the sheet is fed from the sheet feeding cassette 11, the conveying timing toward the imaging part 20, the reversing start timing of the reversing roller 45 for the reversing operation, and the conveying timing of the conveying roller 48*d* when the sheet is returned from the circulation path 48 to the conveying path 1*a*. Further, the sheet feeding and conveying operation also includes an operation in which a sheet having an image printed on a front surface is guided from the conveying path 1*a* to the reversing path 4*b* and a sheet having an image printed on a rear surface is guided from the conveying path 1*a* to the delivery path 4*a* by the switching claw 41.

Accordingly, for example, as illustrated in FIGS. 4A to 4D, each of sheets is fed and conveyed according to a predetermined conveying order so that an image is printed on front and rear surfaces thereof. Here, an image is printed on each of the front surfaces of the sheets SH1, SH2, and SH3, an image is printed on the rear surface of the sheet SH1, an image is printed on the front surface of the sheet SH4, and an image is printed on the rear surface of the sheet SH2.

It is determined whether a jam is detected during a job (step S2). When it is determined that the jam is not detected ("No" of step S2), it is determined whether a final sheet of the plurality of sheets is discharged from the post-processing device 150 (step S3).

When it is determined that the final sheet is not discharged from the post-processing device 150 ("No" of step S3), the routine returns to step S2. When a jam does not occur until the final sheet is discharged from the post-processing device 150, the processes of step S2 and step S3 are repeated. Then, when the final sheet is discharged from the post-processing device 150 ("Yes" of step S3), the corresponding control ends.

When it is determined that the jam is detected during the job ("Yes" of step S2), the conveying operation of the jammed sheet is interrupted (step S4). The interruption is performed in a manner such that a roller actually conveying the jammed sheet is specified and a motor rotationally driving the specified roller is stopped. The roller can be specified in a manner such that a roller existing at the current position on the jammed sheet conveying route among the rollers disposed on the conveying routes is specified. The current position of the jammed sheet is detected in the event of the jam. The information on the roller positions on the conveying routes is stored in advance.

It is determined whether a jam occurs in the post-processing device 150 (step S5). The determination is performed based on whether the main control unit 60 receives the detection result of the jam from the post-processing device 150. When it is determined that the jam does not occur in the post-processing device 150 ("No" of step S5), a downstream sheet discharging control is performed (step S6).

The downstream sheet discharging control is a control that continuously conveys a sheet existing at the downstream side of the jammed sheet in the conveying direction at the jam detection time point and discharges the sheet from the post-processing device 150. Accordingly, since the sheet existing at the downstream side of the jammed sheet in the conveying direction is not stopped while being left inside the apparatus, there is no need to perform a jam removing operation for the sheet. As a result, the effort of the user is reduced.

Then, a message indicating the occurrence of the jam is displayed on the operation panel 51 (step S7) and the corresponding control ends.

In addition, when the jam removing operation is performed so that the jammed sheet is removed from the inside of the apparatus by the user, a message indicating the occurrence of the jam is turned off and the interrupted printing job is resumed.

When it is determined that the jam occurs in the post-processing device 150 ("Yes" of step S5), a purging control is performed (step S8) and the corresponding control ends.

Figure 9:
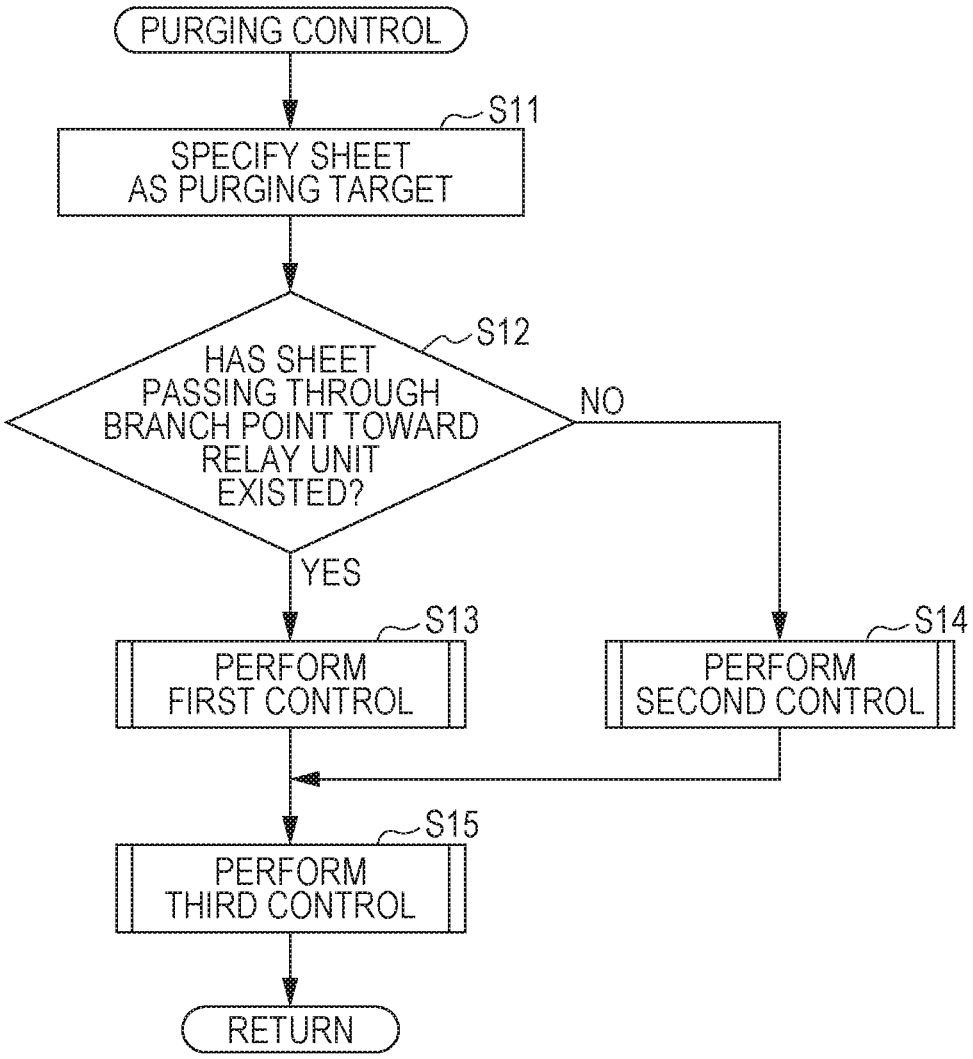
FIG. 9 is a flowchart illustrating the content of a subroutine of a purging control.

FIG. 9 is a flowchart illustrating the content of the sub-routine of the purging control. Then, in the purging control, the purging control unit 402 is activated by the main control unit 60.

As illustrated in FIG. 9, the purging control unit 402 specifies a sheet purging target (step S11). Specifically, the purging control unit 402 reads the sheet position information 421 from the RAM 62 and specifies the position of the sheet currently conveyed on the conveying route at the current time point. Next, it is determined whether each sheet can be conveyed from the position at the current time point to the reversing tray 47 without the interference of the jam. This conveyable sheet is specified as a purging target. In the example of FIG. 6, the sheet C is specified as the sheet purging target.

In addition, if the leading end of the sheet passes by the upstream position Ps even when the leading end does not reach the branch point BP at the jam detection time point, the sheet conveying destination is not switched in time from the delivery path 4*a* to the reversing port 44 by the switching claw 41. For that reason, even if the leading end of the sheet does not actually pass through the branch point BP when the leading end of the currently conveyed sheet passes by the position Ps at the jam detection time point while the switching claw 41 sets the sheet conveying destination to the delivery path 4*a*, the sheet is regarded as the sheet currently passing through the branch point BP and is excluded from the specified purging target.

Then, it is determined whether there is a sheet currently passing through the branch point BP toward the relay unit 140 (step S12). A state where the sheet currently passes through the branch point BP toward the relay unit 140 indicates a state where the leading end of the sheet on the conveying route passes through the position Ps and the tail end thereof does not pass through the branch point BP. Thus, a sheet which is regarded as the sheet currently passing through the branch point BP is also handled as the sheet passing through the branch point BP.

When it is determined that the sheet currently passing through the branch point BP exists ("Yes" of step S12), a first control is performed (step S13), a third control is performed (step S15), and the routine returns. Meanwhile, when it is determined that the sheet currently passing through the branch point BP does not exist ("No" of step S12), a second control is performed (step S14) and the routine proceeds to step S15.

Figure 10:
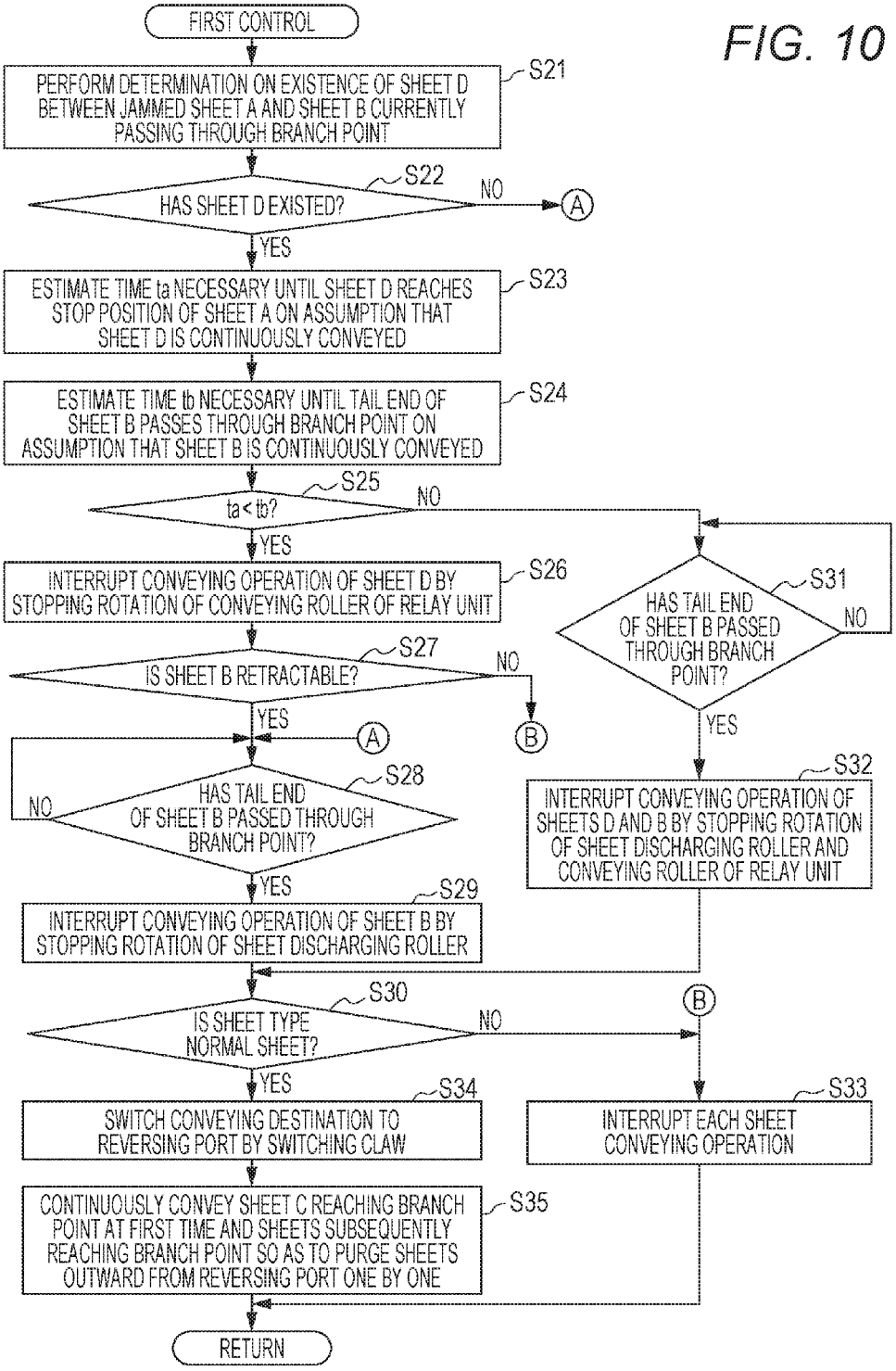
FIG. 10 is a flowchart illustrating the content of a subroutine of a first control.

FIG. 10 is a flowchart illustrating the content of the sub-routine of the first control.

As illustrated in FIG. 10, it is determined whether the sheet D exists between the jammed sheet A and the sheet B currently passing through the branch point BP (step S21). This determination is performed based on the position of each conveyed sheet specified in step S11.

When it is determined that the sheet D exists ("Yes" of step S22), the time ta necessary until the leading end of the sheet D reaches the stop position of the sheet A is estimated on the assumption that the sheet D is continuously conveyed (step S23). The time ta is obtained by the above-described method.

Subsequently, a time tb necessary until the tail end of the sheet B passes through the branch point BP is estimated on the assumption that the sheet B is continuously conveyed (step S24). The time tb is obtained by dividing the distance on the conveying route from the current position of the tail end of the sheet B to the branch point BP by the sheet conveying speed. In addition, since the first control is performed when there is a sheet passing through the branch point BP (the sheet which is regarded as the sheet currently passing through the branch point), the sheet conveying destination of the switching claw 41 is maintained at the delivery path 4*a* until the process of step S34 is performed.

It is determined whether the time relation of ta<tb is satisfied (step S25). If the sheet D is continuously conveyed when this relation is satisfied, the leading end of the sheet D collides with the stop position of the sheet A before the tail end of the sheet B passes through the branch point BP and hence a new jam may occur. Meanwhile, when this relation is not satisfied, the sheet D does not reach the stop position of the sheet A at the time point in which the tail end of the sheet B passes through the branch point BP and hence the collision with the sheet A does not occur. Here, according to the determination in which this relation is satisfied or not, the conveying operation of the sheet D is immediately stopped or the conveying operation is stopped after the tail end of the sheet B passes through the branch point BP.

When it is determined that the time relation of ta<tb is satisfied ("Yes" of step S25), the conveying operation of the sheet D is interrupted while the rotation of the conveying rollers 141 to 143 of the relay unit 140 is stopped (step S26). Due to the interruption, for example, a state illustrated in FIG. 7A is obtained.

Then, it is determined whether the sheet B is retractable to the delivery path 4*a* (step S27). This determination is performed based on whether the relation of Equation 1 is satisfied. Specifically, the sheet is retractable when the relation of Equation 1 is satisfied and the sheet is not retractable when the relation thereof is not satisfied.

When the relation of Equation 1 is satisfied, the sheet B is continuously conveyed, and the leading end of the sheet B reaches the stopped conveying roller 141. Then, when the leading end of the sheet B is bent along the guide plate 145 of the escape section ESC illustrated in FIGS. 7A and 7B, the tail end of the sheet B is located at the downstream side of the branch point BP (so that the tail end passes through the branch point BP). When the relation of Equation 1 is not satisfied, the tail end of the sheet B does not pass through the branch point BP (so that the tail end remains at the branch point BP).

When the relation of Equation 1 is satisfied, that is, the sheet is retractable, the purging operation of another sheet subsequently reaching the branch point BP is allowed. When the relation of Equation 1 is not satisfied, that is, the sheet is not retractable, the purging operation of the sheet is prohibited.

When it is determined that the sheet is retractable ("Yes" of step S27), it is determined whether the tail end of the continuously conveyed sheet B passes through the branch point BP (step S28). When it is determined that the tail end of the sheet passes through the branch point ("Yes" of step S28), the rotation of the sheet discharging roller 43 is stopped so as to interrupt the conveying operation of the sheet B (step S29) and the routine proceeds to step S30. By the interruption, for example, a state illustrated in FIG. 7B is obtained.

Meanwhile, when it is determined that the sheet is not retractable ("No" of step S27), the conveying operation of each sheet to the conveying destination device, that is, the post-processing device 150 is interrupted (step S33) and the routine returns. The sheets include the sheet B and one or more sheets C when there are one or more sheets C reaching the branch point BP after the sheet B passes through the branch point BP. The interruption of the conveying operation of the sheet C corresponds to the prohibition of the purging operation.

When it is determined that the time relation of ta<tb is not satisfied, that is, the time relation of ta≥tb is satisfied ("No" of step S25), it is determined whether the tail end of the continuously conveyed sheet B passes through the branch point BP (step S31). When it is determined that the tail end passes through the branch point ("Yes" of step S31), the rotation of the conveying rollers 141 to 143 of the relay unit 140 is stopped so as to interrupt the conveying operation of the sheet D (step S32) and the routine proceeds to step S30. Since the time relation of ta≥tb is satisfied, there is no need to worry about a problem in which the sheet D reaches the stop position of the sheet A so as to collide with the sheet A even when the tail end of the sheet B passes through the branch point BP and the conveying operation of the sheet D is interrupted.

In step S30, it is determined whether the type of the sheet C as the purging target is a normal sheet. By the determination result, it is possible to determine whether to purge the sheet C. Specifically, when the sheet C is the normal sheet, the purging operation is allowed. When the sheet is not the normal sheet, the purging operation is prohibited. This is due to the following reasons.

That is, when the sheet is, for example, a thin sheet other than the normal sheet, the thin sheet is easily curled due to the weak waist part of the thin sheet. Then, when the sheet is discharged by the purging operation from the reversing port 44 instead of the original discharge port, the sheet which comes out from the reversing port 44 is bent in a round shape in many cases. In this way, the sheet which is bent in a round shape on the reversing tray 47 collides with the leading end of the sheet subsequently discharged from the reversing port 44. Accordingly, the sheet is not smoothly discharged from the reversing port 44 and hence a jam occurs. Thus, there is a need to prevent this jam. In addition, when there is no need to worry about the jam even in the thin sheet, the determination of step S30 may be omitted and the purging operation may be performed regardless of the type of sheet.

When it is determined that the type of the sheet C as the purging target is the normal sheet ("Yes" of step S30), the sheet conveying destination is switched from the delivery path 4*a* to the reversing port 44 by the switching claw 41 (step S34) and the routine proceeds to step S35. The sheet conveying destination of the switching claw 41 is switched by the driving of the driving solenoid SL1.

In step S35, the sheet C reaching the branch point BP at the first time and the sheets subsequently reaching the branch point are continuously conveyed (while not being reversed) and are purged outward from the reversing port 44 one by one. The purged sheet is placed on the reversing tray 47 (FIG. 7B). After the process of step S35 is performed, the routine returns.

When it is determined that the type of the sheet C as the purging target is not the normal sheet ("No" of step S30), the routine proceeds to step S33. Accordingly, the purging operation of the sheet C is prohibited.

Meanwhile, when it is determined that the sheet D does not exist between the sheet A and the sheet B ("No" of step S22), the processes of steps S23 to S27 are skipped (not performed) and the routine proceeds to step S28. In this case, when the sheet gap between the sheet A and the sheet B is wide and the sheet B is continuously conveyed, even a sheet having a maximum size is not long such that the leading end reaches the post-processing device 150 at the time point in which the tail end passes through the branch point BP. Accordingly, the sheet B can be retracted to the delivery path 4*a* without causing the collision between the leading end of the sheet B and the sheet A.

In addition, in the case of "No" of step S22, in step S29 after step S28, the rotation of the conveying rollers 141 to 143 of the relay unit 140 is also stopped in addition to the sheet discharging roller 43 so that the conveying operation of the sheet B is interrupted. Further, the process of step S30 may be performed before, for example, the start of the process of step S21 or the first control. If the other steps can be also controlled, the order may be different from the order illustrated in the drawing.

Figure 11:
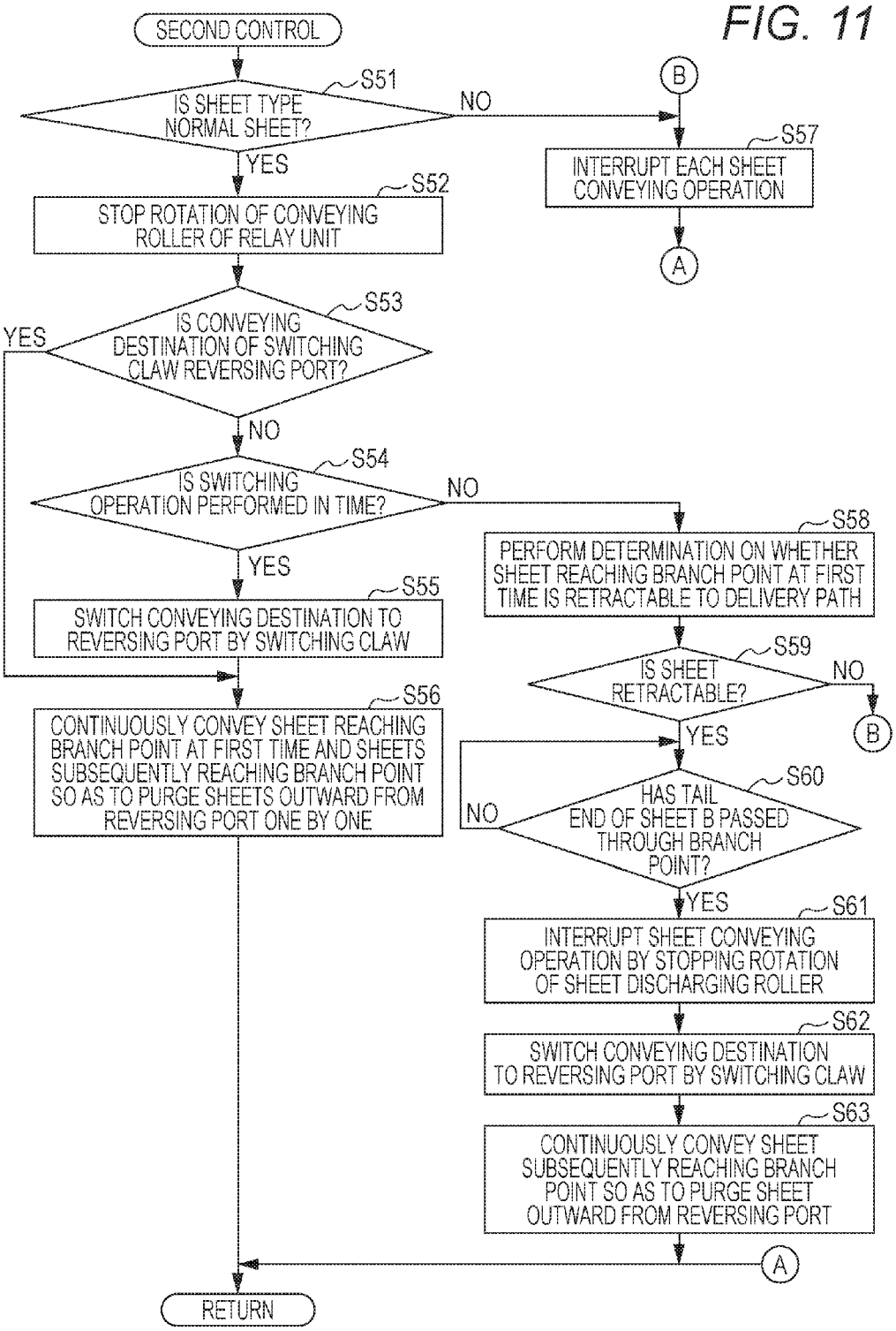
FIG. 11 is a flowchart illustrating the content of a subroutine of a second control.

FIG. 11 is a flowchart illustrating the content of the sub-routine of the second control.

As illustrated in FIG. 11, when it is determined that the type of sheet as the purging target is the normal sheet ("Yes" of step S51), the conveying rollers 141 to 143 of the relay unit 140 are stopped (step S52). Accordingly, when there is a sheet conveyed on the conveying route between the jammed sheet A and the branch point BP, the conveying operation of the sheet is interrupted.

Then, it is determined whether the sheet conveying destination of the switching claw 41 is the reversing port 44 (step S53).

When it is determined that the sheet conveying destination is the reversing port 44 ("Yes" of step S53), the routine proceeds to step S56. Meanwhile, when it is determined that the sheet conveying destination is the delivery path 4*a* instead of the reversing port 44 ("No" of step S53), it is determined whether the sheet conveying destination is switched from the delivery path 4*a* to the reversing port 44 in time by the switching claw 41 until the leading end of the sheet reaches the branch point BP on the assumption that the conveying operation of the sheet reaching the branch point BP at the first time is continued (step S54). The determination on whether the switching operation is performed in time is performed when the above-described switching condition is satisfied, that is, the current position of the leading end of the sheet reaching the branch point BP at the first time is the upstream position of the position Ps illustrated in FIGS. 7A and 7B in the conveying direction.

In addition, when the sheet conveying speed can be ignored with respect to the swing speed of the switching claw 41, the reversing path 4*b* can be formed by the switching claw 41 before the leading end of the first sheet reaches the branch point BP regardless of the jam detection time point. In that case, the determination of step S54 may be omitted and the routine may proceed to step S55.

When it is determined that the sheet conveying destination is switched in time ("Yes" of step S54), the sheet conveying destination is switched from the delivery path 4*a* to the reversing port 44 in time by the switching claw 41 (step S55) and the routine proceeds to step S56.

In step S56, the conveying operation of the sheet reaching the branch point BP at the first time and the sheets subsequently reaching the branch point is continued (while the sheets are not reversed) and the sheets are purged outward from the reversing port 44 one by one. The purged sheet is placed on the reversing tray 47. After the process of step S56 is performed, the routine returns.

Meanwhile, when it is determined that the sheet conveying destination of the switching claw 41 is not switched in time ("No" of step S54), it is determined whether the sheet is retractable to the delivery path 4*a* while the conveying operation of the sheet reaching the branch point BP at the first time is continued (step S58). This determination is performed similarly to the method of step S27.

When it is determined that the sheet is retractable ("Yes" of step S59), the rotation of the sheet discharging roller 43 is stopped so as to interrupt the conveying operation of the sheet (step S61) when the tail end of the sheet reaching the branch point BP at the first time passes through the branch point BP ("Yes" of step S60). Further, when the tail end of the sheet passes through the branch point BP, the sheet conveying destination is switched from the delivery path 4*a* to the reversing port 44 by the switching claw 41 (step S62).

Then, the conveying operation of the sheet reaching the branch point BP at the next time and the sheets subsequently reaching the branch point is continued (while the sheets are not reversed), the sheets are sequentially purged outward from the reversing port 44 one by one (step S63), and the routine returns. Meanwhile, when it is determined that the sheet is not retractable ("No" of step S59), the routine proceeds to step S57.

When it is determined that the type of sheet as the purging target is not the normal sheet ("No" of step S51), the routine proceeds to step S57.

In step S57, the conveying operation of all sheets is interrupted and the routine returns. The interruption of the conveying operation of the sheet corresponds to the prohibition of the purging operation of the sheet specified as the purging target.

Figure 12:
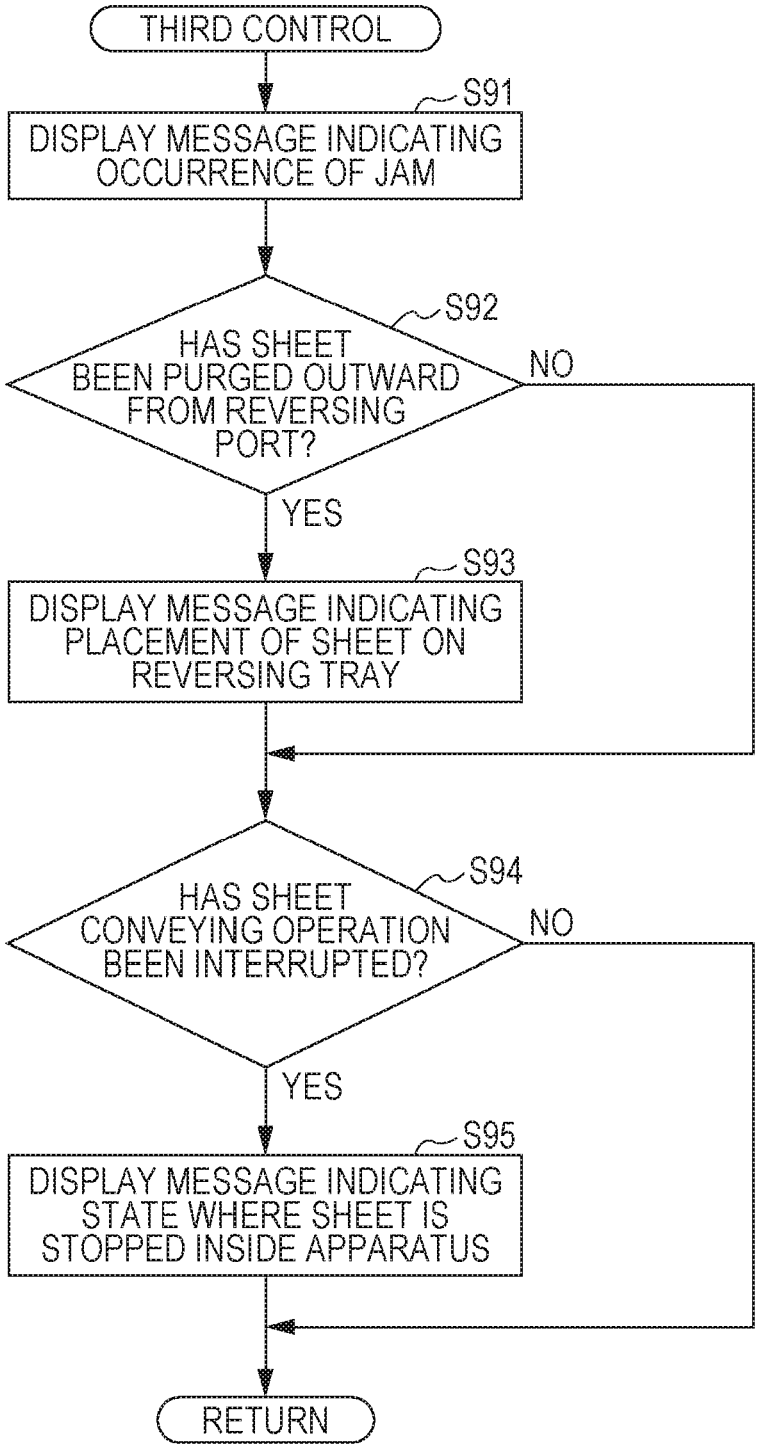
FIG. 12 is a flowchart illustrating the content of a subroutine of a third control.

FIG. 12 is a flowchart illustrating the content of the sub-routine of the third control.

As illustrated in FIG. 12, a message indicating the occurrence of the jam is displayed on the operation panel 51 (step S91).

Then, it is determined whether the sheet is purged outward from the reversing port 44 (step S92). When it is determined that the sheet is purged ("Yes" of step S92), a message indicating the placement of the sheet on the reversing tray 47 is displayed on the operation panel (step S93) and the routine proceeds to step S94. Meanwhile, when it is determined that the sheet is not purged from the reversing port 44 ("No" of step S92), the process of step S93 is skipped and the routine proceeds to step S94.

In step S94, it is determined whether the conveying operation of the sheet is interrupted. When it is determined that the conveying operation of the sheet is interrupted ("Yes" of step S94), a message indicating the stop of the sheet inside the printer 130 and the relay unit 140 is displayed on the operation panel 51 (step S95) and the routine returns. Meanwhile, when it is determined that the conveying operation of the sheet is not interrupted ("No" of step S94), the process of step S95 is skipped and the routine returns. When there is one message of the display target, only the message is displayed. When there are two or more messages, these messages are displayed in parallel at the same time.

In addition, when the sheet as the purging target is not specified, that is, the sheet as the purging target does not exist at the jam detection time point in step S11, the conveying operation of the currently conveyed sheet is interrupted, the third control is performed (step S15), and the corresponding process ends.

As described above, if there is the sheet B passing through the branch point BP toward the relay unit 140 when a jam occurring in the post-processing device 150 is detected during the duplex printing job for a plurality of sheets, the sheet B is retracted to the delivery path 4*a* and the sheet C reaching the branch point BP is continuously conveyed, is guided from the branch point BP to the reversing port 44, and is purged outward from the reversing port 44 while not being reversed.

Accordingly, it is possible to prevent the sheet C (or the sheets C, E, and F) from being stopped inside the printer 130. As a result, the user may perform an operation of removing the jammed sheet A and the sheet B retracted to the delivery path 4*a* or the sheets B and D stopped in an overlapping state. Thus, the trouble of the user in the sheet removing operation is reduced.

Further, in the description above, the purging operation is prohibited when the sheet C as the purging target is the thin sheet. However, for example, the purging operation may not prohibited in response to the type of the sheet B retracted to the delivery path 4*a* in addition to or instead of the above-described configuration. Specifically, when the type of the sheet B is a specific type of sheet, the purging operation is prohibited while the conveying operation of each sheet is stopped.

As the specific type of sheet, for example, any one of a high-quality sheet, a glossy sheet, a coated sheet, and a color sheet may be used. When the sheet is retracted to the delivery path 4*a*, the conveying operation is continued for an extra time compared with the case where the conveying operation is immediately stopped at the jam detection time point. Accordingly, the sheet is not bent or wrinkled during the conveying operation. Since the high-quality sheet and the like are more expensive than a normal sheet, damage on the sheets can be prevented in a manner such that the purging operation is prohibited after the conveying operation is stopped from the jam detection time point.

The present invention is not limited to the sheet conveying device and the image forming apparatus and the image forming system including the same, and the present invention may be applied to a purging control method. Further, the method may be a program that is executed by a computer. Further, a program according to the present invention can be stored in, for example, a magnetic disk such as a magnetic tape and a flexible disk, an optical recording medium such as a DVD-ROM, a DVD-RAM, a CD-ROM, a CD-R, a MO, and a PD, a flash memory recording medium. In this way, the program can be stored in various recording media which can be read by a computer. The program can be manufactured and distributed in the form of the corresponding recording medium or can be transmitted and supplied through various wired and wireless networks including the internet, a broadcasting, an electric communication line, or a satellite communication.

Modified Example

While the embodiment of the present invention has been described, the present invention is not limited to the above-described embodiment and a modified example may be considered as below.

(1) In the above-described embodiment, the escape section ESC is provided inside the relay unit 140, but the escape section may not be provided. In this case, Equation 2 below is used instead of Equation 1 above.

$$L1<Ls<(L1+L2) \quad \text{(Equation 2)}$$

Equation 2 corresponds to an equation when L3 of Equation 1 above is set to 0.

Further, in the above-described embodiment, the purging operation is prohibited based on the determination that the sheet B cannot be retracted to the delivery path 4*a* when Equation 1 is not satisfied ("No" of step S27 and "No" of S59), but the present invention is not limited thereto.

For example, even when Equation 1 is not satisfied, the sheet discharging roller 43 may be continuously rotated so as to convey the sheet B to the delivery path 4*a*. In this case, the sheet B may be bent while being forcedly pressed into the delivery path 4*a*. However, the sheet B retracted to the delivery path 4*a* is removed by the hand of the user similarly to the jammed sheet A in the jam removing operation. For this reason, the sheet B may be retracted to the delivery path 4*a* regardless of the determination on whether Equation 1 is satisfied before the purging operation of the sheet C.

(2) In the above-described embodiment, the length of the sheet in the sheet conveying direction is not particularly mentioned. However, for example, a so-called elongated sheet longer than the normal sheet may be used. When the sheet B passing through the branch point BP at the jam detection time point is the elongated sheet, there is a case in which the tail end of the sheet B does not pass through the branch point BP even when the leading end of the sheet B reaches the stop position of the sheet A stopped by a jam when the sheet B is continuously conveyed depending on the length of the sheet B. In this case, when the sheet B is continuously conveyed until the tail end of the sheet B passes through the branch point BP, the leading end of the sheet B is easily bent while contacting the sheet A.

It is desirable to avoid the bending of the sheet caused by the contact of the sheets A and B in that the sheets may cause a new jam. Here, when the contact of the sheets A and B is assumed, a control of prohibiting the purging operation of the sheet C may be used.

Figure 13:
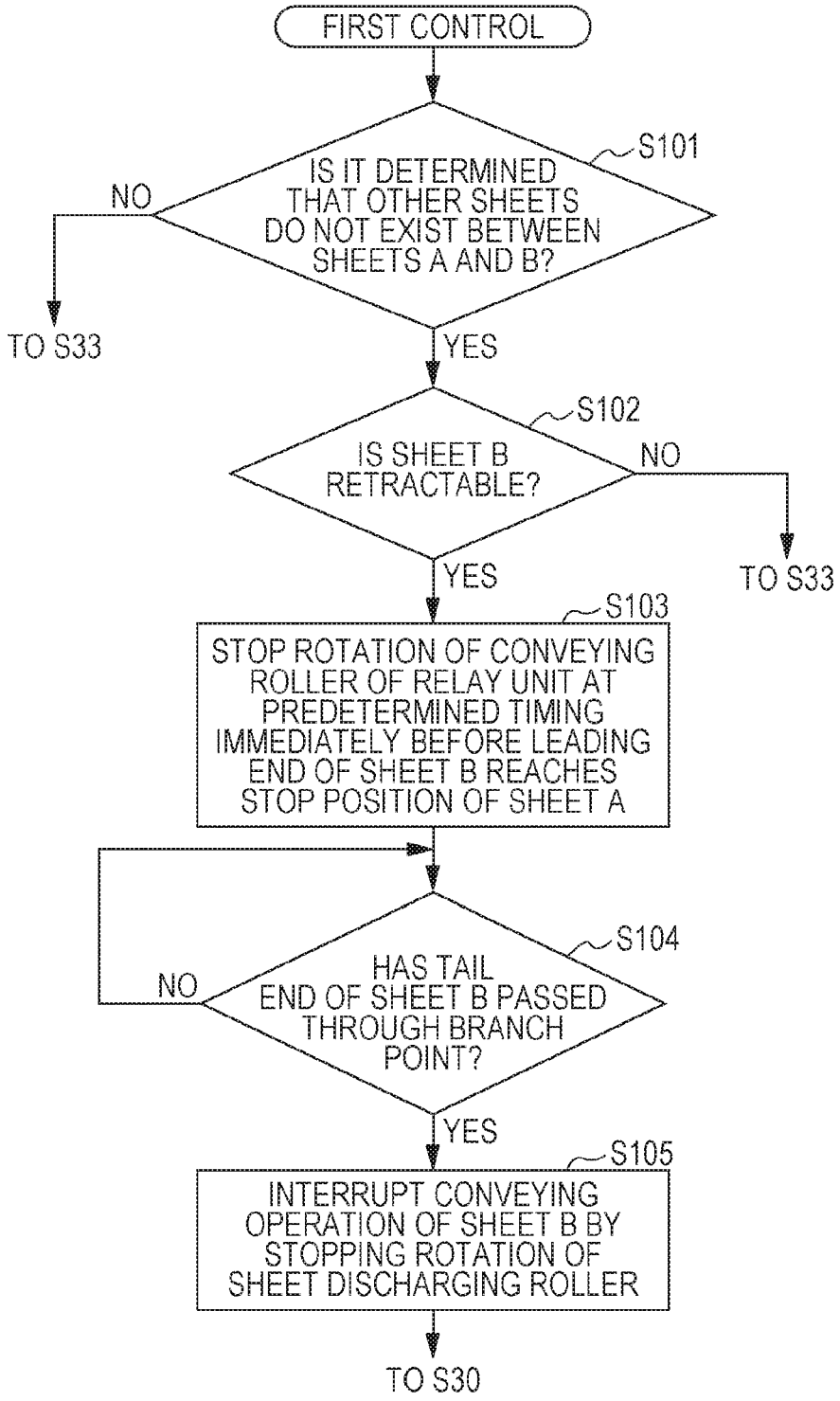
FIG. 13 is a flowchart illustrating the content of a first control according to a modified example.

FIG. 13 is a flowchart illustrating a part of the content of the first control according to the modified example in the case of the elongated sheet. Here, only the difference from the first control illustrated in FIG. 10 is described.

As illustrated in FIG. 13, when it is determined that no sheet exists between the sheet A and the sheet B ("Yes" of step S101), it is determined whether the sheet B is retractable to the delivery path 4*a* (step S102). The determination is made as below.

Figure 14:
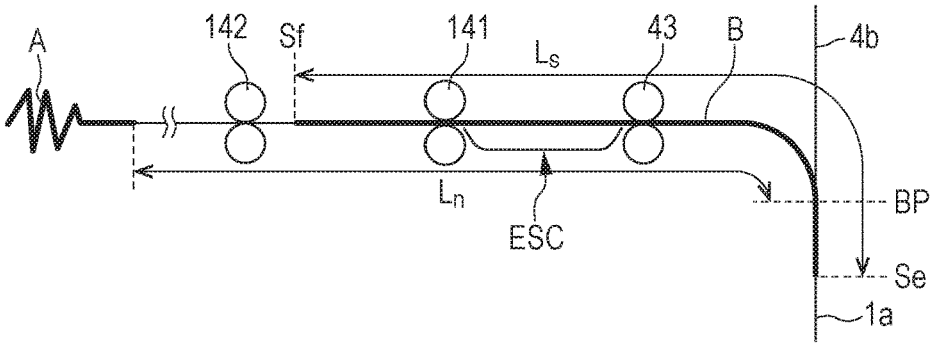
FIG. 14 is a schematic diagram illustrating a distance from a stop position of a sheet to a branch point on a conveying route and a length of a sheet in the conveying direction.

That is, as illustrated in FIG. 14, the determination can be made by the relation of Equation 3 when the distance on the conveying route from the stop position of the sheet A to the branch point BP is denoted by Ln and the length of the sheet B in the conveying direction is denoted by Ls.

$$Ls<(Ln+L3) \quad \text{(Equation 3)}$$

When the relation of Equation 3 is satisfied, even when the conveying operation of the sheet B bent by the maximal bent amount in the escape section ESC is interrupted at the time point in which the tail end Se of the sheet B passes through the branch point BP, the leading end Sf of the sheet B does not reach the stop position of the sheet A. Accordingly, the tail end Se of the sheet B can be conveyed toward the downstream side of the branch point BP while the leading end Sf of the sheet B does not contact the sheet A. Thus, it is possible to determine that the sheet B is retractable to the delivery path 4*a* when the relation of Equation 3 is satisfied. In addition, the length Ls of the sheet B in the conveying direction may be acquired from the detection value of the size detection sensor similarly to the normal size or the input information of the user through the operation unit 50 or the like.

When the relation of Equation 3 is not satisfied, the leading end Sf of the sheet B contacts the sheet A at the time point in which the tail end Se of the sheet B passes through the branch point BP. Thus, it is determined that the sheet is not retractable. The leading end Sf of the sheet B is easily bent while contacting the sheet A and this contact may cause a new jam. When it is determined that the sheet is not retractable ("No" of step S102), the routine proceeds to step S33. In this case, the purging operation is prohibited and the conveying operation of the sheets B and C is interrupted.

Meanwhile, when it is determined that the sheet is retractable ("Yes" of step S102), the rotation of the conveying rollers 141 to 143 of the relay unit 140 is stopped at a predetermined timing (for example, a position of several millimeters) immediately before the leading end of the sheet B reaches the stop position of the sheet A (step S103).

Then, when the tail end of the sheet B passes through the branch point BP ("Yes" of step S104), the rotation of the sheet discharging roller 43 is stopped and the conveying operation of the sheet B is interrupted (step S105). Accordingly, the sheet B is retracted to the delivery path 4*a*. Then, the routine proceeds to step S30.

Further, when it is determined that another sheet exists between the sheet A and the sheet B ("No" of step S101), the routine proceeds to step S33. When the sheet existing between the sheet A and the sheet B is an elongated sheet, it is determined that the sheet B is not retractable and the purging operation is prohibited.

Likewise, even when the elongated sheet is used, it is possible to reduce the effort of the user in the jam removing operation by the use of the purging control.

In the description above, a case has been described in which the elongated sheet is used, but the present invention is not limited thereto. For example, there is also known an apparatus in which the conveying path downstream from the sheet discharging port 42 is short. In such an apparatus, the sheet B like A3 having a normal size may have the same problem as the elongated sheet such that the tail end of the sheet B does not pass through the branch point BP when the leading end of the sheet B reaches the stop position of the sheet A due to the jam. Thus, even in the sheet having a normal size in which the length in the conveying direction is equal to or longer than a predetermined value, the first control illustrated in FIG. 13 may be performed.

Further, instead of this configuration, for example, in the determination of "No" of step S22 of the first control illustrated in FIG. 10, the determination of step S102 illustrated in FIG. 13 is performed. Then, the routine proceeds to S33 when it is determined that the sheet B is not retractable ("No" of step S102), and the routine proceeds to step S28 illustrated in FIG. 10 when it is determined that the sheet B is retractable ("Yes" of step S102).

(3) In the above-described embodiment, a case is not particularly described in which the sheet D existing between the jammed sheet A and the sheet B passing through the branch point BP corresponds to the purging condition, but the sheet D can be additionally used as the purging condition.

Figure 15:
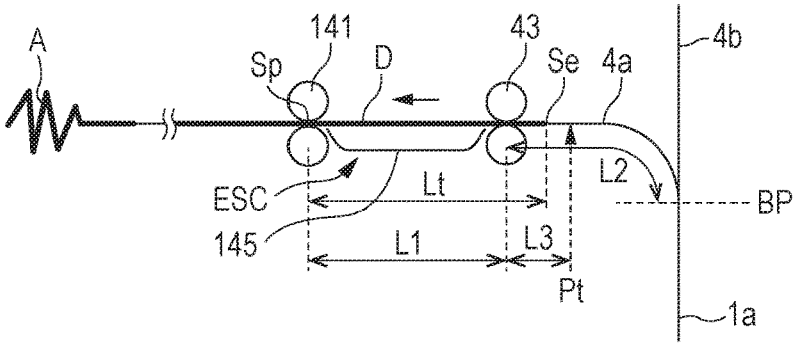
FIG. 15 is a schematic diagram illustrating a positional relation of a length of a sheet in the conveying direction with respect to a conveying roller and a sheet discharging roller.
Figure 16:
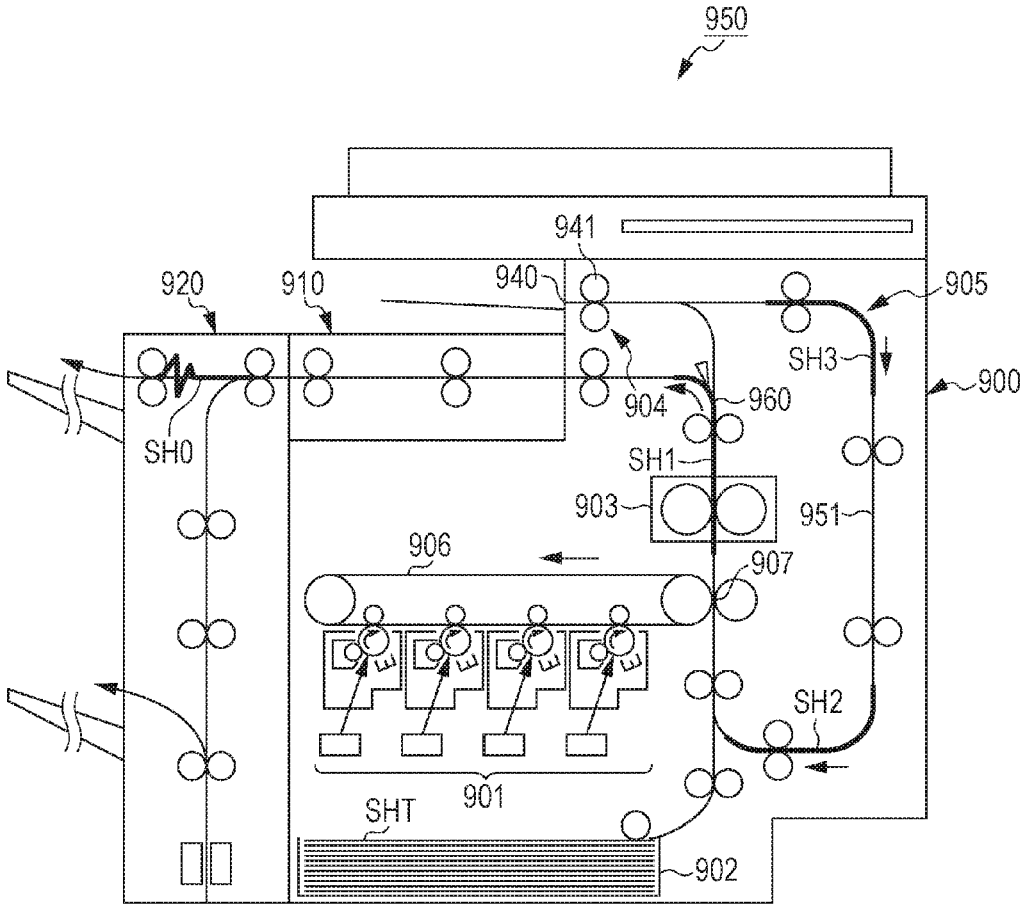
FIG. 16 is a diagram illustrating a schematic configuration of an image forming system of the related art.

For example, as illustrated in FIG. 15, the purging condition can be allowed only when the relation of Equation 4 is satisfied on the assumption that Lt denotes a length from a part Sp nipped between the pair of conveying rollers 141 in the sheet D to the tail end Se of the sheet D at the time point in which the rotation of the conveying roller 141 of the relay unit 140 is stopped due to the detection of the jam (step S26 of FIG. 10).

$$Lt\leq(L1+L3) \quad \text{(Equation 4)}$$

If the rotation of the sheet discharging roller 43 is continued while the conveying roller 141 is stopped when the relation of Equation 4 is satisfied, the tail end Se of the sheet D passes through the sheet discharging roller 43 before the bent amount of the sheet D due to the guide plate 145 becomes a maximum value. That is, even when the rotation of the sheet discharging roller 43 is continued, the sheet D is stopped while the entire part from the position Sp of the sheet D to the tail end Se follows the guide plate 145.

Meanwhile, when the relation of Equation 4 is not satisfied, that is, the relation of Lt>(L1+L3) is satisfied, the bent amount of the sheet D due to the guide plate 145 becomes maximal before the tail end Se of the sheet D passes through the sheet discharging roller 43. The state where the bent amount becomes the maximum value indicates a state where the sheet D cannot be bent along the guide plate 145.

Thus, if the sheet D is continuously conveyed by the sheet discharging roller 43 even after the bent amount of the sheet D becomes the maximum value, the sheet D is further pressed into the escape section ESC from the front and rear direction while the sheet D is maximally bent along the guide plate 145. Accordingly, the sheet D is easily bent or wrinkled.

Since the sheet D is not the jammed sheet, the user feels comfortable when the printed sheet D is stopped while not being bent or wrinkled.

Here, a control is considered in which the purging operation is prohibited when the relation of Equation 4 is not satisfied so as to interrupt the conveying operation of the sheets, that is, the sheets B and C along with the sheet D.

(4) Further, as a condition for determining whether to allow or prohibit the purging operation, for example, the following condition can be used. That is, on the assumption that Lq indicates a distance on the conveying route from the leading end of the current sheet B to the conveying roller 141 in a state where the sheet discharging roller 43 is continuously rotated while the rotation of the conveying roller 141 is stopped and the leading end of the sheet B does not reach the conveying roller 141 at the jam detection time point, the purging operation of the sheet C can be prohibited so as to interrupt the conveying operation of the sheets when the tail end of the sheet B does not pass through the branch point BP at the time point in which the sheet B is conveyed by a distance Lu (=Lq+L3).

The distance Lu corresponds to the conveying distance of the sheet B until the leading end of the sheet B contacts the stopped conveying roller 141 so that the sheet B is bent to the maximum amount in the escape section ESC after the sheet B is continuously conveyed. Thus, the distance Lu means the upper-limit conveying distance of the sheet B retractable to the delivery path 4*a* while the sheet B is not bent. When the tail end of the sheet B does not pass through the branch point BP even when the sheet B is actually conveyed by the upper-limit conveying distance Lu, the purging operation is prohibited at the time point so as to prevent damage involved with the bending of the sheet B.

In the above-described embodiment, the conveying operation of the sheets B and C is immediately interrupted when the prohibition of the purging operation is determined. However, in the modified example, the sheet B is conveyed until the conveying distance becomes the upper-limit distance Lu. In the meantime, when the tail end of the sheet B passes through the branch point BP, the purging operation is allowed. Then, when the tail end cannot pass through the branch point even when the sheet B is conveyed by the distance Lu, the purging operation is prohibited.

Specifically, in step S27, the distance Lu is obtained at the jam detection time point. Then, when the tail end of the sheet B passes through the branch point BP until the conveying distance of the sheet B from the jam detection time point becomes the upper-limit distance Lu, the rotation of the sheet discharging roller 43 is stopped so as to stop the conveying operation of the sheet B and the purging operation of the sheet C is performed.

Meanwhile, when the tail end of the sheet B does not pass through the branch point BP at the time point in which the conveying distance of the sheet B becomes the upper-limit distance Lu, the rotation of the sheet discharging roller 43 is stopped so as to stop the conveying operation of the sheet B. At the same time, the purging operation of the sheet C is prohibited and the conveying operation of the sheet C is interrupted.

(5) In the above-described embodiment, a configuration example has been described in which the user inputs the setting of the sheet type (the normal sheet and the like) from the operation panel 51, but the present invention is not limited thereto. For example, the setting can be detected by a sensor or the like. Further, as the sheet type, a letterhead sheet or an OHP sheet also exists in addition to the above-described examples. Whether the purging control is allowed or prohibited in advance in accordance with the type of sheet can be determined in advance.

(6) In the above-described embodiment, an example has been described in which the image forming apparatus including the sheet conveying device according to the present invention is applied to the tandem type printer 130, but the present invention is not limited to the tandem type printer. Further, the present invention can be generally applied to an image forming apparatus, for example, a copying machine and a facsimile device having a duplex image forming function of forming an image such as a toner image on both surfaces (the first surface and the second surface) of the sheet regardless of the color and monochrome image forming function. Further, the present invention is not limited to the electrophotographic type image forming apparatus. For example, the present invention can be also applied to an inkjet type image forming apparatus. In addition, the present invention is not limited to the image forming apparatus and can be generally applied to a sheet conveying device that conveys a sheet to a device at a sheet conveying destination.

Further, the post-process of the post-processing device 150 may include a process of sorting the sheet, a process of binding and punching the sheet, a process of folding the sheet into two parts, or a process of inserting another sheet into the sheet bundle other than the process of evenly arranging the sheet bundle and the process of stapling the sheet bundle.

Further, in the description above, a configuration example has been described in which the purging control is performed in the printer 130 when the jam occurs in the post-processing device 150, but the purging control can be performed when the jam occurs in the device at the sheet conveying destination to which the sheet is discharged from the printer 130. Since the device at the sheet conveying destination also includes the relay unit 140, the purging control can be performed in the printer 130 when the jam occurs in any one of the post-processing device 150 and the relay unit 140.

Further, the configurations of the above-described embodiments and the above-described modified examples may be combined with one another.

The present invention can be widely applied to the sheet conveying device that conveys the sheet.

According to an embodiment of the present invention, since the second sheet is continuously conveyed until the tail end of the second sheet passing through the branch point in the sheet conveying direction completely passes through the branch point at the sheet jam detection time point, the second sheet does not stay at the position of the branch point and the conveying route from the conveying path toward the reversing port through the branch point is ensured. Accordingly, it is possible to purge the subsequent third sheet outward from the reversing port. Accordingly, it is possible to reduce the effort of the user in the sheet removing operation at the jam detection time point.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A sheet conveying device configured to convey a sheet toward a device at a conveying destination in a normal operation state and to interrupt the sheet conveying operation toward the device at the conveying destination when a jam is detected, the sheet conveying device comprising:

a conveying unit configured to convey a sheet along a conveying path;

a switching unit configured to switch a sheet conveying destination from a branch point as a downstream end of the conveying path to any one of a delivery path extending toward the device at the sheet conveying destination and a reversing port formed as an opening of a casing of the sheet conveying device so that a space outside the casing is used as a space for reversing a sheet conveying direction;

a delivering unit configured to deliver the sheet on the delivery path toward the device at the sheet conveying destination;

a reversing unit configured to first convey the sheet from the reversing port toward the outside of the casing to a position in which a part of the sheet protrudes and then delivers the sheet from the position toward a circulation path while reversing the conveying direction of the sheet;

a circulating unit configured to convey the sheet delivered toward the circulation path along the circulation path and return the sheet to the conveying path while the sheet is reversed; and a control unit configured to detect a jam of a first sheet in the device at the conveying destination, and to control the conveying unit, the reversing unit, the delivering unit, the circulating unit, and the switching unit so that a second sheet is continuously conveyed until a tail end of the second sheet in the sheet conveying direction passes through the branch point, and a conveying destination of a third sheet reaching the branch point is switched to the reversing port after the tail end of the second sheet in the sheet conveying direction passes through the branch point, so that the third sheet is purged from the reversing port toward the outside of the casing while not being reversed when the second sheet conveyed from the branch point to the delivery path currently passes through the branch point and there is the third sheet currently conveyed by at least one of the conveying unit, the reversing unit, and the circulating unit at the jam detection time point of the first sheet in the device at the conveying destination.

2. The sheet conveying device according to claim 1, wherein the control unit includes a determination unit configured to determine whether a leading end of a fourth sheet in the sheet conveying direction reaches a stop position of the first sheet before the tail end of the second sheet in the sheet conveying direction passes through the branch point on the assumption that the fourth sheet and the second sheet are continuously conveyed when the fourth sheet is currently conveyed between the first sheet and the second sheet on the delivery path at the jam detection time point, and wherein when the determination is made, the conveying operation of the fourth sheet is interrupted and, when the tail end of the second sheet in the sheet conveying direction passes through the branch point, the conveying operation of the second sheet is stopped.

3. The sheet conveying device according to claim 2, further comprising an escape section provided at a halfway position of the delivery path so as to receive the second sheet stopped after the continuous conveying operation thereof such that the second sheet overlaps the stopped fourth sheet.

4. The sheet conveying device according to claim 3, further comprising:

a pair of first rotating and conveying members provided at an upstream side of the escape section in the sheet conveying direction on the delivery path and conveying the sheet in a nipping state and a pair of second rotating and conveying members provided at a downstream side of the escape section in the sheet conveying direction and conveying the sheet in a nipping state, wherein:

the escape section is provided with an expanded part receiving the sheet in a bent state, and when the determination is made, the control unit stops rotation of the second rotating and conveying members so as to interrupt the conveying operation of the fourth sheet, continues rotation of the first rotating and conveying members, and stops the rotation of the first rotating and conveying members so as to stop the conveying operation of the second sheet when the tail end of the second sheet in the sheet conveying direction passes through the branch point.

5. The sheet conveying device according to claim 4, wherein the control unit prohibits the purging operation of the third sheet and stops each sheet conveying operation when the relation of Equation 1:

$$Ls<(L1+L2+L3) \quad \text{(Equation 1)}$$

is not satisfied on the assumption that L1 denotes a distance on the conveying route from the pair of first rotating and conveying members to the pair of second rotating and conveying members, L2 denotes a distance on the conveying route from the branch point to the pair of first rotating and conveying members, L3 denotes an amount in which a maximal bent amount obtained by bending a straight sheet along the expanded part is converted into a length of the sheet in the sheet conveying direction, and Ls denotes a length of the second sheet in the sheet conveying direction.

6. The sheet conveying device according to claim 4, wherein on the assumption that Lq denotes a distance on the conveying route from a leading end of the second sheet in the sheet conveying direction to the pair of second rotating and conveying members at the jam detection time point, L3 denotes an amount in which a maximal bent amount obtained by bending a straight sheet along the expanded part is converted into a length of the sheet in the sheet conveying direction, and Lu denotes (Lq+L3) when the leading end of the second sheet in the sheet conveying direction does not reach the pair of second rotating and conveying members at the jam detection time point, the control unit stops the rotation of the first rotating and conveying members so as to stop the conveying operation of the second sheet and performs the purging operation of the third sheet when the tail end of the second sheet in the sheet conveying direction passes through the branch point until the conveying distance of the second sheet from the jam detection time point becomes Lu after the rotation of the second rotating and conveying members is stopped, and the control unit stops the rotation of the first rotating and conveying members so as to stop the conveying operation of the second sheet, prohibits the purging operation of the third sheet, and stops the conveying operation of the third sheet when the tail end of the second sheet in the sheet conveying direction does not pass through the branch point at the time point in which the conveying distance becomes Lu.

7. The sheet conveying device according to claim 4, wherein the control unit prohibits the purging operation of the third sheet and stops each sheet conveying operation when Equation 2:

$$Lt(L1+L3) \quad \text{(Equation 2)}$$

is not satisfied on the assumption that L1 denotes a distance on the conveying route from the pair of first rotating and conveying members to the pair of second rotating and conveying members, L3 denotes an amount in which a maximal bent amount obtained by bending a straight sheet along the expanded part is converted into a length of the sheet in the sheet conveying direction, and Lt denotes a length from a part nipped by the pair of second rotating and conveying members in the fourth sheet to a tail end of the fourth sheet in the sheet conveying direction at the jam detection time point.

8. The sheet conveying device according to claim 1, further comprising:

an escape section provided at a halfway position of the delivery path and having an expanded part receiving the sheet in a bent state;

a pair of first rotating and conveying members provided at an upstream side of the escape section in the sheet conveying direction on the delivery path and conveying the sheet in a nipped state; and a pair of second rotating and conveying members provided at a downstream side of the escape section in the sheet conveying direction and conveying the sheet in a nipped state, wherein the control unit includes a determination unit configured to determine whether a leading end of the second sheet in the sheet conveying direction reaches a stop position of the first sheet before the tail end of the second sheet in the sheet conveying direction passes through the branch point on the assumption that the second sheet is continuously conveyed when another sheet is not conveyed between the first sheet and the second sheet on the delivery path at the jam detection time point, and wherein when the determination is made, rotation of the second rotating and conveying members is stopped, rotation of the first rotating and conveying members is continued, and when the tail end of the second sheet in the sheet conveying direction passes through the branch point, the rotation of the first rotating and conveying member is stopped so as to stop the conveying operation of the second sheet.

9. The sheet conveying device according to claim 1, further comprising:

a pair of first rotating and conveying members conveying the sheet in a nipped state on the delivery path; and a pair of second rotating and conveying members provided at a downstream side of the pair of first rotating and conveying members in the sheet conveying direction and conveying the sheet toward the downstream side in the sheet conveying direction while nipping the sheet conveyed from the pair of first rotating and conveying members, wherein the control unit stops rotation of the second rotating and conveying members and continues rotation of the first rotating and conveying members at the jam detection time point, and stops the rotation of the first rotating and conveying members so as to stop the conveying operation of the second sheet when the tail end of the second sheet in the sheet conveying direction passes through the branch point.

10. The sheet conveying device according to claim 9, wherein the control unit stops the purging operation and stops each sheet conveying operation if the relation of Equation 3:

$$Ls<(L1+L2) \quad \text{(Equation 3)}$$

is not satisfied when a leading end of the second sheet in the sheet conveying direction does not reach the pair of second rotating and conveying members on the assumption that L1 denotes a distance on the conveying route from the pair of first rotating and conveying members to the pair of second rotating and conveying members, L2 denotes a distance on the conveying route from the branch point to the pair of first rotating and conveying members, and Ls denotes a length of the second sheet in the sheet conveying direction.

11. The sheet conveying device according to claim 9, further comprising:

an escape section having an expanded part receiving a sheet in a bent state while being provided between the pair of first rotating and conveying members and the pair of second rotating and conveying members at a halfway position of the delivery path, wherein on the assumption that Lq denotes a distance on the conveying route from a leading end of the second sheet in the sheet conveying direction to the pair of second rotating and conveying members at the jam detection time point, L3 denotes an amount in which a maximal bent amount obtained by bending a straight sheet along the expanded part is converted into a length of the sheet in the sheet conveying direction, and Lu denotes (Lq+L3) when the leading end of the second sheet in the sheet conveying direction does not reach the pair of second rotating and conveying members at the jam detection time point, when the tail end of the second sheet in the sheet conveying direction passes through the branch point until the conveying distance of the second sheet from the jam detection time point becomes Lu after the rotation of the second rotating and conveying members is stopped, the control unit stops the rotation of the first rotating and conveying members so as to stop the conveying operation of the second sheet and performs the purging operation of the third sheet, and when the tail end of the second sheet in the sheet conveying direction does not pass through the branch point at the time point in which the conveying distance becomes Lu, the control unit stops the rotation of the first rotating and conveying members so as to stop the conveying operation of the second sheet, stops the purging operation of the third sheet, and stops the conveying operation of the third sheet.

12. The sheet conveying device according to claim 1, wherein when there is a sheet satisfying a condition in which a leading end of the third sheet in the sheet conveying direction reaches the branch point before the conveying destination is completely switched from the delivery path to the reversing port by the switching unit on the assumption that the third sheet not actually passing through the branch point and reaching the branch point at the first time is continuously conveyed at the jam detection time point, the control unit regards the sheet as the second sheet and continues the conveying operation of the sheet while keeping the sheet conveying destination to the delivery path.

13. The sheet conveying device according to claim 1, wherein the control unit stops each sheet conveying operation by prohibiting the purging operation when the second sheet is a predetermined type of sheet.

14. The sheet conveying device according to claim 13, wherein the predetermined type of sheet is any one of a high-quality sheet, a glossy sheet, a coated sheet, and a color sheet.

15. The sheet conveying device according to claim 1, wherein the control unit stops each sheet conveying operation by prohibiting the purging operation when the third sheet is a specific type of sheet.

16. The sheet conveying device according to claim 15, wherein the specific type of sheet is a thin sheet having a basis weight smaller than a predetermined value.

17. An image forming apparatus configured to form an image on a sheet conveyed by a sheet conveying part, the image forming apparatus comprising the sheet conveying device according to claim 1 as the sheet conveying part.

18. An image forming system comprising:

the image forming apparatus according to claim 17; and a post-processing device configured to perform predetermined post-processing on a sheet having an image formed thereon by the image forming apparatus, wherein a device at a sheet conveying destination of a sheet conveying device in the image forming apparatus is the post-processing device.

* * * * *